US008322115B2

(12) United States Patent
Foell et al.

(10) Patent No.: US 8,322,115 B2
(45) Date of Patent: Dec. 4, 2012

(54) INSERT PANEL FOR CONCRETE FILLABLE FORMWORK WALL

(75) Inventors: David S. Foell, Strongsville, OH (US); William M. Bjerke, Hudson, OH (US)

(73) Assignee: PolyOne Corporation, Avon Lake, OH (US)

( * ) Notice: Subject to any disclaimer, the term of this patent is extended or adjusted under 35 U.S.C. 154(b) by 1440 days.

(21) Appl. No.: 10/531,622

(22) PCT Filed: Oct. 14, 2003

(86) PCT No.: PCT/US03/32467

§ 371 (c)(1), (2), (4) Date: Apr. 14, 2005

(87) PCT Pub. No.: WO2004/038118

PCT Pub. Date: May 6, 2004

(65) Prior Publication Data

US 2006/0005497 A1 Jan. 12, 2006

(51) Int. Cl.

| | |
|---|---|
| ***E04F 13/074*** | (2006.01) |
| ***E04F 13/076*** | (2006.01) |
| ***E04G 21/00*** | (2006.01) |
| *E04B 2/86* | (2006.01) |
| *E04C 1/00* | (2006.01) |

(52) U.S. Cl. ..... 52/855; 52/309.17; 52/439; 52/745.1

(58) Field of Classification Search ..... 52/439, 52/425, 426, 427, 429, 309.15, 309.17, 855, 52/241, 745.1

See application file for complete search history.

(56) References Cited

U.S. PATENT DOCUMENTS

| | | | | |
|---|---|---|---|---|
| 3,288,427 | A * | 11/1966 | Pluckebaum | 249/192 |
| D244,942 | S | 7/1977 | Bobrovniczky | |
| 4,583,359 | A | 4/1986 | Staeger | |
| 5,106,233 | A | 4/1992 | Breaux | 405/129.8 |
| D327,516 | S | 6/1992 | Ingvarsson | |

(Continued)

FOREIGN PATENT DOCUMENTS

| | | |
|---|---|---|
| BE | 400 252 | 1/1934 |

(Continued)

OTHER PUBLICATIONS

Abstract of EP 0 244 851 from www.espacenet.com.

*Primary Examiner* — Michael Safavi
(74) *Attorney, Agent, or Firm* — John H. Hornickel

(57) ABSTRACT

A formwork assembly is adapted to receive concrete to produce structures such as wall structures. The formwork includes PVC tubular form elements having recessed female engagement portions. The female engagement portions are adapted to receive respective male engagement portions. An octagonal form element has a female engagement portion positioned at each vertex between adjacent sides. A recessed female engagement portion is closed to the interior of the form element but open to the exterior of the form element. Thus, the form element includes a plurality of vertices open to the exterior. The form elements also include male engagement portions at an open side. Wall panels, corner panels, and joint connectors can also include the male engagement portions. The male engagement portions and female engagement portions are adapted to mate to form a formwork arrangement having a substantially flat exterior wall. A formwork assembly can additionally include concrete flow apertures and insulation.

4 Claims, 31 Drawing Sheets

U.S. PATENT DOCUMENTS

| | | | | | |
|---|---|---|---|---|---|
| 5,216,863 | A | | 6/1993 | Nessa et al. | 52/439 |
| 5,465,545 | A | * | 11/1995 | Trousilek | 52/425 |
| 5,491,947 | A | * | 2/1996 | Kim | 52/426 |
| 5,553,430 | A | * | 9/1996 | Majnaric et al. | 52/425 |
| 5,608,999 | A | * | 3/1997 | McNamara | 52/275 |
| 5,706,620 | A | | 1/1998 | De Zen | 52/220.2 |
| 5,740,648 | A | | 4/1998 | Piccone | 52/426 |
| 5,860,262 | A | * | 1/1999 | Johnson | 52/426 |
| 5,974,751 | A | | 11/1999 | De Zen | 52/439 |
| 5,992,109 | A | * | 11/1999 | Jonker | 52/241 |
| 6,021,618 | A | * | 2/2000 | Elderson | 52/667 |
| 6,167,669 | B1 | * | 1/2001 | Lanc | 52/426 |
| 6,219,984 | B1 | | 4/2001 | Piccone | 52/426 |
| 6,247,280 | B1 | * | 6/2001 | Grinshpun et al. | 52/309.12 |
| 6,435,471 | B1 | * | 8/2002 | Piccone | 249/47 |

FOREIGN PATENT DOCUMENTS

| | | |
|---|---|---|
| EP | 0 244 851 | 11/1987 |

* cited by examiner

INSERT PANEL FOR CONCRETE FILLABLE FORMWORK WALL

TECHNICAL FIELD

This invention relates to formwork adapted for use in casting concrete structures. The invention also involves a method of arranging interconnectable formwork elements in forming a formwork. Particularly, this invention relates to interconnectable formwork elements adapted for use in forming concrete walls with flat surfaces.

BACKGROUND OF THE INVENTION

The use of form elements which interconnect to form a wall structure into which concrete can be poured is known. The prior art formwork assemblies often result in arrangements that preclude a principle surface from being flat. In some formwork assemblies the desired pattern, such as flat surfaces at corners, is unobtainable due to the formwork engagement portions or connections available. That is, the form elements and their connections can be unarrangeable to achieve a formwork with a flat surface. In other formwork assemblies the pressure of poured concrete often results in the surface bulging due to lack of strength in the formwork element connections. Still other formwork assemblies are complicated and difficult to assemble and/or add internal components such as insulation, rebar, etc., which can result in loss of time and assembly errors, such as misalignment of wall surfaces. Further, during assembly some formwork arrangements can require inner braces to be inserted into a formwork element subsequent to the formwork element being connected to another formwork element.

Further drawbacks in the prior art involve the use of engagement portions or fins which extend outwardly from a form element body. Difficulties can arise from such form elements, such as in nesting for shipping, manually handling, snagging during assembly, as well as the overall aesthetics issue of having exterior engagement portions. These external engagement fins can also interfere with the formation of a flat surface.

The prior art formwork assemblies can lead to quality control problems, especially when stringent construction specifications are required. Other problems can also arise due to required length of assembly time and difficulty of assembly. Additionally, since errors in assembly may not be noticeable until the formwork is nearly completed, difficulty in rearranging prior art formworks can cause delays and increase costs.

DISCLOSURE OF THE INVENTION

Thus, there exists a need in the art for a formwork for casting concrete structures which enjoys ease and quickness of assembly, can result in a flat surface, and can be easily modified once assembled to allow on-site alterations. Such a formwork, and its assembly, would also contribute to alleviating the problems of the prior art.

An aspect of an exemplary form of the present invention is to provide a formwork arrangement having interconnectable formwork components.

A further aspect of an exemplary form of the present invention is to provide a formwork adapted for use in casting concrete structures, such as a concrete wall.

A further aspect of an exemplary form of the present invention is to provide a formwork form element with recessed female engagement portions.

A further aspect of an exemplary form of the present invention is to provide a form element with extending male engagement portions.

A further aspect of an exemplary form of the present invention is to provide a form element with both recessed female engagement portions and extending male engagement portions.

A further aspect of an exemplary form of the present invention is to provide a form element with male engagement portions which are adapted to engage corresponding respective female engagement portions of another form element.

A further aspect of an exemplary form of the present invention is to provide a form element of tubular configuration with an open end.

A further aspect of an exemplary form of the present invention is to provide a form element with male engagement portions, adjacent an open end, which are adapted to engage corresponding respective female engagement portions of another form element.

A further aspect of an exemplary form of the present invention is to provide a formwork with wall panels and/or corner panels that include male engagement portions.

A further aspect of an exemplary form of the present invention is to provide a formwork with wall panels and/or corner panels having male portions adapted to engage corresponding female portions of a form unit resulting in a substantially flat wall surface.

A further aspect of an exemplary form of the present invention is to provide a formwork arrangement which includes apertures permitting concrete to freely flow between adjacent form work chambers.

A further aspect of the present invention is to provide a formwork arrangement which permits ease of rebar installations.

A further aspect of the present invention is to provide a formwork arrangement which permits ease of modification after assembly A further aspect of an exemplary form of the present invention is to provide a form work arrangement with apertures in form elements and/or panels so as to permit concrete to cross flow into formwork chambers.

A further aspect of an exemplary form of the present invention is to provide a formwork that is easy to clean, does not burn, has an attractive appearance, is reflective, is chemical resistant, is of high strength, and/or does not require components below grade.

A further aspect of an exemplary form of the present invention is to provide a formwork that is adapted for use in any residential or nonresidential structure. A nonresidential structure can be an agriculture facility, such as a hog barn or in a storage structure for agriculture wastes.

A further aspect of an exemplary form of the present invention is to provide a formwork that is adapted for use in a cleaning facility, such as in an auto wash structure or other facility that needs regular cleaning for regulatory reasons.

Further aspects of exemplary forms of the present invention will be made apparent in the following Embodiments of Invention and the appended Claims.

The foregoing aspects are accomplished in an exemplary embodiment of the present invention by the use of interconnectable formwork components.

The formwork components can be assembled to form a formwork assembly in which concrete can be held to form a substantially flat surface, either an entire wall or a portion thereof. Male portions of a wall panel can be connected to respective female portions of adjacent tubular form elements. Male portions of a corner panel can be connected to respective female portions of a tubular form element. A connection arrangement of tubular form elements, wall panels, corner panels, and joint connectors can permit an alignment resulting in a substantially flat wall configuration.

Flow apertures in formwork components, such as tubular form elements, can permit poured concrete to cross flow through the form elements resulting in an even dispersion of concrete and a quicker casting time.

Some embodiments can use material, apertures, arrangements, and orientations disclosed in U.S. Pat. No. 5,216,863, the disclosure of which is incorporated herein by reference.

Thus, a formwork of the exemplary embodiment can include tubular form elements capable of receiving concrete to form a wall structure. The formwork can include a PVC or other polymeric form element with a female engagement portion positioned at each joint between two adjacent walls. The female engagement portions are closed to the interior of the form element but open to the exterior of the form element. That is, the form element includes open vertices. The form elements each include an open longitudinal side and male engagement portions adjacent thereto. The male engagement portions can extend radially outwardly from their respective form element adjacent the open side.

The formwork can include other formwork connecting members adapted to interconnect the form elements and create a substantially flat exterior wall surface. These other formwork connecting members can include wall panels, corner panels, external joint connectors, and internal joint connectors, with a desirable feature being that such members are modular for efficient design and convenient assembly.

For example, a preferred geometry for such members is a regular geometry permitting symmetric design and construction. Of the regular geometric forms, a regular octagon is preferred. Regular geometric forms in even multiples are also possible. Moreover, the members can have interconnectivity with other non-modular frameworks. Each of the formwork components, e.g., form elements, wall panels, corner panels, external joint connectors, and internal joint connectors can be of an integral or one-piece construction.

Furthermore, each of the form work components can be molded and/or extruded. Additionally, the formwork components can use male/female engagement relationships that permit identification of common loci of each connection with the placement of each locus at the vertices of a regular geometric form.

The exemplary wall panels have an integral substantially flat wall surface with a male engagement portion at each end. Both male engagement portions extend from the same side of the wall surface. Each male engagement portion has a first projection and an integral second projection. The first projections extend substantially parallel to the wall surface and each other, and the second projections extend toward each other. The second projections can extend substantially perpendicular.

The exemplary corner panels have two integrally joined substantially perpendicular and substantially flat wall surfaces with two free ends. Both free ends include a male engagement portion. Both male engagement portions extend from the same (inner or outer) side of the corner. Each male engagement portion has a first projection and an integral second projection. The first projections extend substantially parallel to their respective wall surface and perpendicular to each other, and the second projections extend parallel to each other. The second projections can further extend toward each other.

The exemplary external joint connectors include both a male engagement portion and a female engagement portion integrally connected by a common elongated member.

The exemplary internal joint connectors include two integrally connected male engagement portions. In cross section each male engagement portion extends on both sides of an integral common elongated member. Each male engagement portion has a first projection and an integral second projection. The first projections are parallel and the second projections extend away from each other.

During assembly of an exemplary embodiment the male engagement portions and female engagement portions of particular form elements, wall panels, corner panels, external joint connectors, and internal joint connectors can be mated to form a formwork having a substantially flat exterior wall surface.

EMBODIMENTS OF INVENTION

An exemplary formwork of the present invention can include a form element or unit (10) having a tubular structure. A tubular form element is adapted to contain concrete as discussed in more detail later. A form element in longitudinal cross section can be circular, oval, polygonal, octagonal, sixteen edged, rectangular, and other tubular shapes. For reasons of brevity, an octagonal shaped form element is discussed in detail herein. However, it should be understood that the present invention is not limited to use with an octagonal form element but that other form element cross sections can be used.

Figure 1:
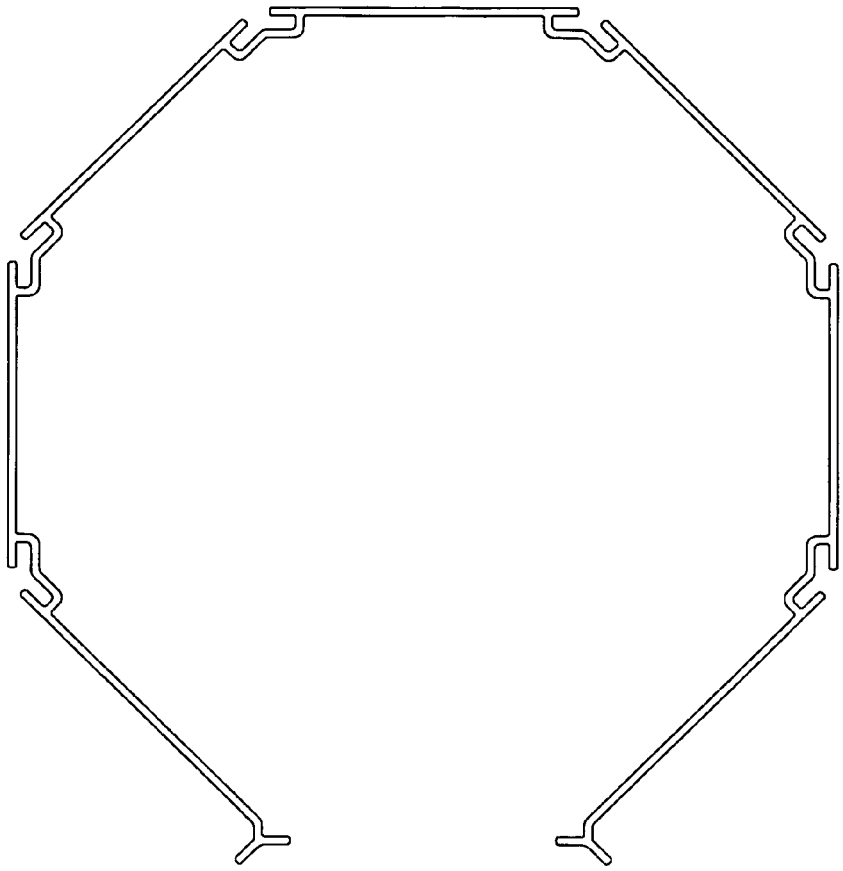
FIG. 1 shows a form element of an exemplary embodiment of the present invention.

FIG. 1 shows a form element of an exemplary embodiment of the present invention. A form element 10 of octagonal shape is shown in the exemplary embodiment of FIG. 1. The octagonal form element 10 includes eight vertices 12 of substantially equal spacing. The form element 10 is elongated longitudinally. The form element includes an elongated longitudinal interior chamber 13. The form element of FIG. 1 also includes seven walls or faces 14 and one elongated open face, end, or side 16. In FIG. 1 the walls are substantially of equal length and positioned at substantially equal angles forming a substantially C-shaped form element in cross section. However, it should be understood that in other exemplary embodiments a form element can have walls not of substantially equal length and positioned not at substantially equal angles. Also, a form element can include other shapes in cross section, such as without an open end, circular, or O-shaped. For example, an octagonal form element can have eight walls without an open face.

The form element 10 can include a respective female engagement portion or member 18 at one or more joinings (e.g., vertex or corner) of two adjacent faces. For example, the form element 10 of FIG. 1 is shown with six respective female engagement portions.

Figure 2:
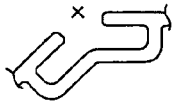
FIG. 2 shows a female engagement portion in combination with the beginning of adjoining wall portions.

An exemplary embodiment of a female engagement portion 18 is shown in FIG. 2. FIG. 2 shows a female engagement portion in combination with the beginning of adjoining wall portions. A female engagement portion can comprise a slot, groove, indentation, recess, pocket, opening, or other similar engagement structure. The female engagement portion is of a shape permitting mating engagement with a corresponding male engagement member. For example, a female engagement portion can comprise a T-shaped slot in cross section. Of course a female engagement portion can have other alternative configurations, such as P-shaped or H-shaped or Y-shaped. The female engagement portions can extend the entire vertical length or only a partial length of the formwork. Each female engagement portion can be located internally of an exterior boundary of the form element. For example, with an octagonal form element, the female engagement portions can be located internally of an exterior octagonal boundary of the octagonal form element.

Figure 3:
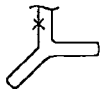
FIG. 3 shows a male engagement portion in combination with the beginning of an adjoining wall portion.

Each female engagement portion 18 is adapted to mate with a respective male engagement portion or member. A form element 10 can include both female engagement portions and male engagement portions. An exemplary embodiment of a male engagement portion 20 is shown in FIG. 3. FIG. 3 shows a male engagement portion in combination with the beginning of an adjoining wall portion. A male engagement portion can comprise one or more of an engagement fin, projection, finger, lip, or other similar engagement structure. A male engagement portion is of a shape permitting mating engagement with a corresponding female engagement member. For example, a male engagement portion can comprise a T-shaped fin. The T-shaped fin is adapted to engage a T-shaped slot (or a slot of a shape permitting engagement with a T-shaped fin). Of course a male engagement portion can have other alternative configurations, such as P-shaped or H-shaped or Y-shaped. The male/female engagement relationships permit identification of common loci of each connection with the placement of each locus at the vertices of a regular octagon.

Figure 4:
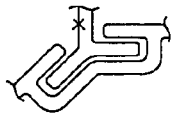
FIG. 4 shows a male portion in operative engagement with a female portion.

An engagement arrangement permits male and female loci to fall on a vertex of a form element. Vertices of a form element can exist at an intersection of extended adjacent outer edges of a form element. As shown in FIG. 2, an intersection point is indicated by the mark "x". That is, the locus of a female portion can be indicated by the mark "x" in FIG. 2. The locus of a male portion can be indicated by the mark "x" in FIG. 3. When a male and a female portion are in engaged relationship, then the male portion locus and the female portion locus can commonly meet or overlap at a vertex of a form element. That is, the male and female portions can share a common locus during their engagement or connection. FIG. 4 shows a male portion 20 in operative engagement or connection with a female portion 18. FIG. 4 shows an example of the permitted commonality of each male and female locus. The male/female engagement relationships can permit the placing of common loci from each connection at each of the vertices of the form elements in a formwork assembly. Thus, a formwork assembly can be truly modular.

FIG. 1 shows a form element 10 having two male engagement portions 20 adjacent the open face 16. Each male portion can be arranged to extend outside of the exterior boundary of a form element. For example, each male portion can extend outside of the exterior octagonal boundary of an octagonal form element. Thus, a male portion 20 of a first form element is adapted to engage a female portion 18 of an adjacent second form element to engage, interconnect, or lock together the two form elements. FIG. 4 shows an engagement relationship of a male portion 20 and a female portion 18.

In a form element, each of the walls, female portions, and male portions can be integral. The form element can be of a one piece construction. For example, the form element can be of a molded and/or extruded structure.

A form element can have all of the inward extending female portions of the same configuration and all of the outward extending male portions of the same configuration. However, it should be understood that a form element need not have the same engagement configurations. For example, the female portions of a particular form element can differ from each other. Likewise, the male portions of a particular form element can differ from each other. Nor do the male portions on a form element have to match the female portions on that same form element. Further, the formwork can include some form elements having all corresponding male and female portions and other form elements having all alternative corresponding male and female portions. Still, other formworks can have varying corresponding male and female portions. Even with varying configurations, each respective male portion is adapted to be aligned to match a corresponding respective female portion to permit engagement, interconnection, or locking of the male and female portions during assembly.

Various types of assembly processes can be used to result in engagement of male and female portions. For example, male and female portions can be respectively engaged to each other by sliding engagement. That is, a male portion can slide into and relative to a female portion, and/or a female portion can slide outside of and relative to a male portion. The sliding can occur over the entire length, such as the height, of a portion. For example, during assembly a male portion can be slid inside of a female portion in a direction parallel to and along a longitudinal axis of the female portion. Other types of assembly processes can be used, such as one including a snap-fit type of engagement. For example, during a snap-fit assembly a male portion can be relatively moved into a female portion in a direction perpendicular to a longitudinal axis of the female portion. Still other assembly processes can include movement of a male portion both perpendicular and parallel to a longitudinal axis of a female portion. For example, a female portion can comprise a longitudinal extending pocket with vertically spaced horizontal slots thereto which permit a male portion to be moved perpendicularly into the female portion and then moved parallel along the female portion to a final assembly position.

The arrangement of a form element 10 permits the internalization of the engagement points. That is, engagement of male and female portions can occur internally of the exterior boundary of a form element. This allows all external side surfaces, such as walls 14, of the form element to lie within a plane for creation of a flat surface arrangement.

Figure 5:
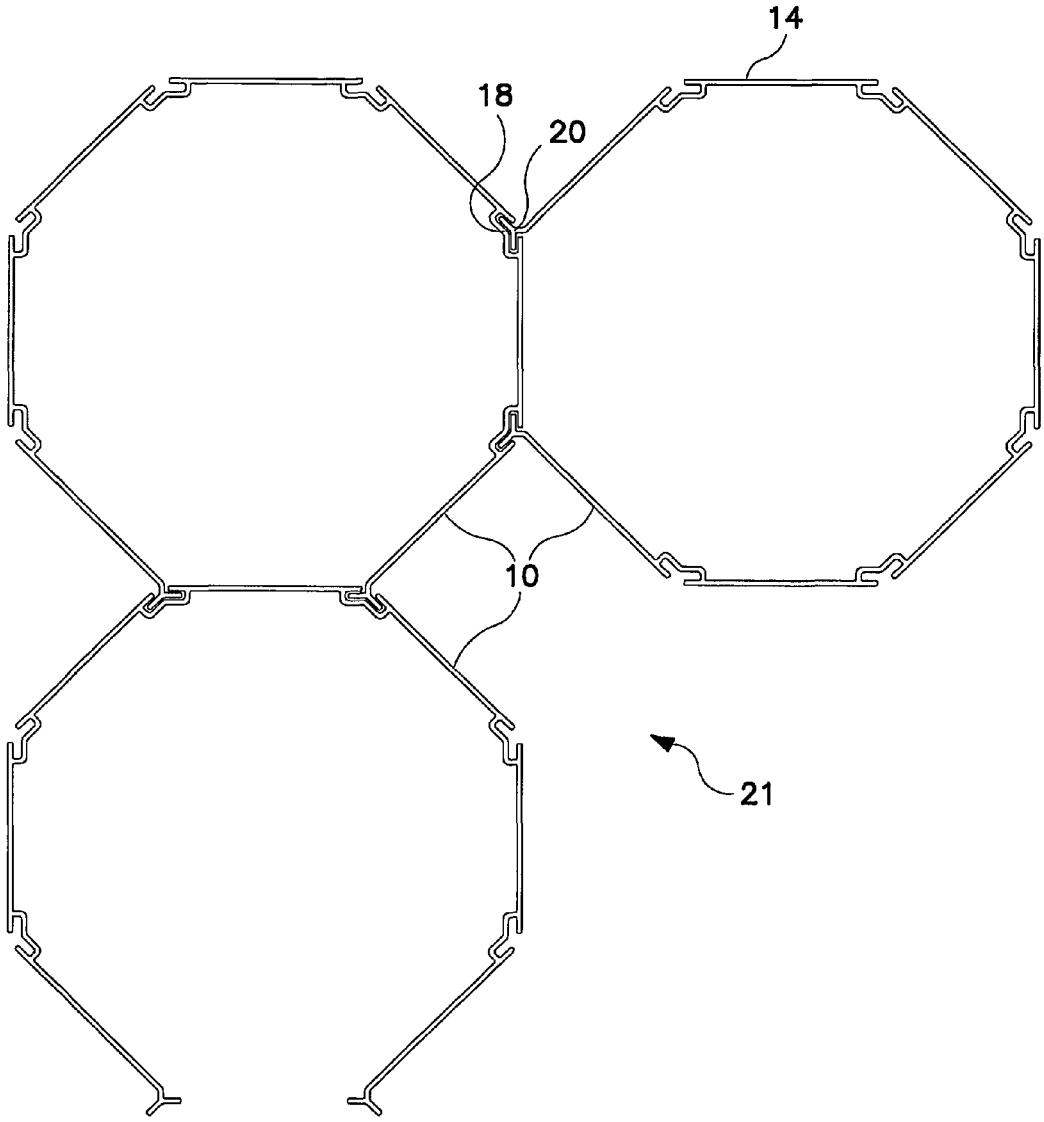
FIG. 5 shows an exemplary formwork section having an arrangement of engaged form elements.

FIG. 5 shows a formwork arrangement 21 of engaged form elements 10. The arrangement permits the production of corners and intersections without projections extending beyond a flat wall surface 14 of a form element 10. FIG. 5 also shows the engagement of male portions 20 of a first form element 10 respectively engaging female portions 18 of an adjacent second form element 10.

Figure 6:
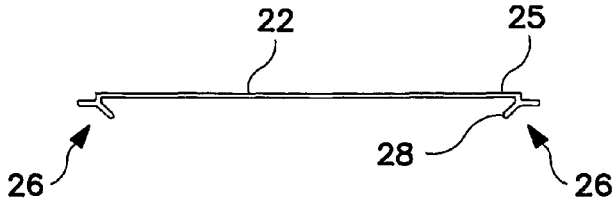
FIG. 6 shows an exemplary wall panel.

An exemplary embodiment of the present invention also includes use of a panel which is adapted to engage at least one female engagement portion of a form element for use in forming an arrangement having a substantially flat wall. FIG. 6 shows a flat panel insert or wall panel 22. The wall panel 22 can be separate or distinct from a form element. The wall panel has at least one end 25 with a male engagement portion 26. The male engagement portion 26 can be of similar configuration and operation as the previously discussed male engagement portions. Like the previously discussed male engagement portions, the male engagement portion 26 can comprise one or more of an engagement fin, projection, finger, or lip 28. Of course other alternative configurations and sizes of wall panels and/or male portions can be used, such as shown in FIGS. 32-37. A male engagement portion is adapted to engage a matching female engagement portion. FIG. 6 shows each end of wall panel 22 having identical male end engagement portions 26. The male engagement portions 26 of FIG. 6 are adapted to engage two female engagement portions of adjacent form elements.

Figure 7:
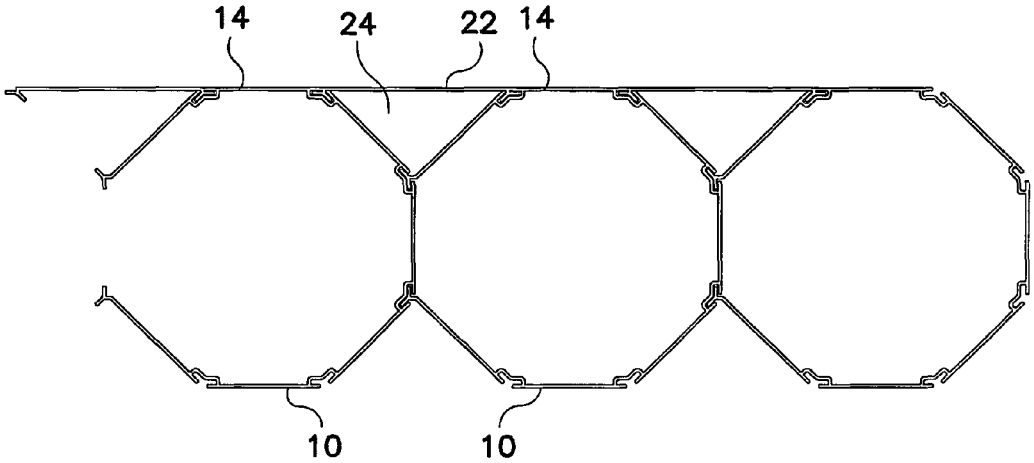
FIG. 7 shows an exemplary formwork section having engaged form elements with a wall panel.

The wall panel 22 of FIG. 6 includes a substantially straight or flat surface. As shown in FIG. 7, a panel 22 permits the parallel but spaced faces 14 of two adjacent form elements 10 to be connected or engaged in parallel relationship. Thus, the wall panel 22 can be used in forming a substantially flat wall including at least the two faces and the wall panel. A completed flat wall of a formwork can include several alternating form element faces and wall panels. A wall panel 22 can also be used to close an open cross-sectional triangular open space or area 24 created between two engaged form elements as shown in FIG. 7. The closed area 24 can remain an open channel or be operative to hold concrete or insulation. Additionally, the area 24 can be used for service items, such as wiring or plumbing. The area 24 can also be used as a fluid, such as air, conveying mechanism. A wall panel 22 can also have insulation directly adhered to an interior side thereof. For example, the insulation can be attached using an adhesive or the insulation can be snap-fitted onto a wall panel projection. One or more layers of insulation can be applied using a LEGO® block type of attachment arrangement. Examples of insulation are shown in FIGS. 56-59. In an exemplary embodiment, insulation can be placed between horizontal rebar and forced into a final position by the pressure of poured concrete. Attachment of insulation prior to wall assembly can result in a decrease in assembly time. Of course insulation can also be attached to other form work components (e.g., form elements and panels) in a similar manner. Additionally, insulation can be fastened, such as by adhering, to the outside of a formwork wall section. The insulation can then be covered or hidden by traditional finishing techniques, such as siding, brick, etc.

It should be understood that the use of "substantially flat wall" herein includes not only a perfectly flat wall but an imperfect flat wall with reasonable deviations due to imperfections, misalignments, seams, and other factors, such as temperature, pressure, size, and age. For convenience the terms "flat wall" and "substantially flat wall" can be interchanged herein. Furthermore, "flat" can comprise planer. A flat wall can also comprise all surfaces lying within the same plane, including a cylindrical plane.

Figure 8:
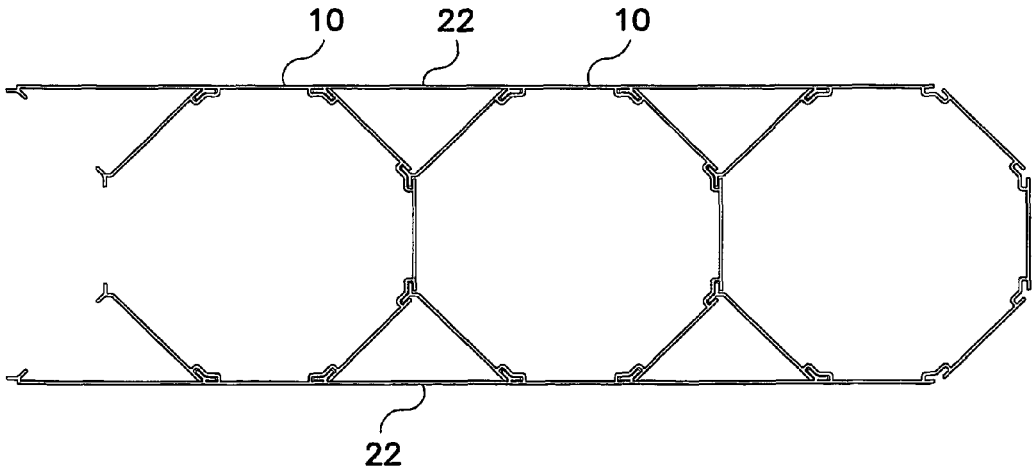
FIG. 8 shows an exemplary formwork section having engaged form elements with wall panels on opposite walls.

FIG. 8 shows wall panels 22 on two opposite sides of plural engaged form elements 10. Thus, two (e.g., interior and exterior) substantially flat and parallel wall surfaces can be formed for a concrete wall structure by using form elements and wall panels.

Figure 9:
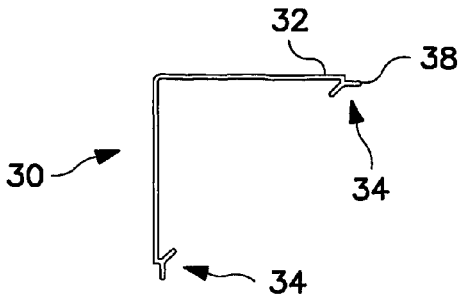
FIG. 9 shows an exemplary corner panel.
Figure 10:
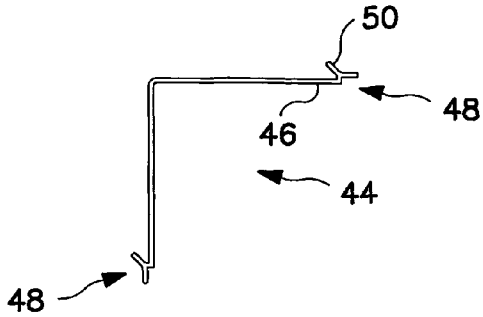
FIG. 10 shows an alternative corner panel.

FIGS. 9 and 10 show other insert panels which are adapted to engage at least one female engagement portion of a form element for use in forming an arrangement having a flat wall. FIG. 9 shows a corner panel 30 adapted to engage two female engagement portions of a single form element. The corner insert panel 30 can be separate or distinct from a form element. The panel 30 has at least one end 32 with a male engagement portion 34. The male engagement portion 34 can be of similar configuration and operation as the previously discussed male engagement portions. Thus, the male engagement portion 34 can comprise one or more of an engagement fin, projection, finger, or lip 38. Of course a male engagement portion of panel 30 can have other alternative configurations. FIG. 9 shows each end of corner panel 30 having an identical male end engagement portion 34. The male engagement portions 34 are adapted to engage respective matching female engagement portions, such as those of a form element.

Figure 11:
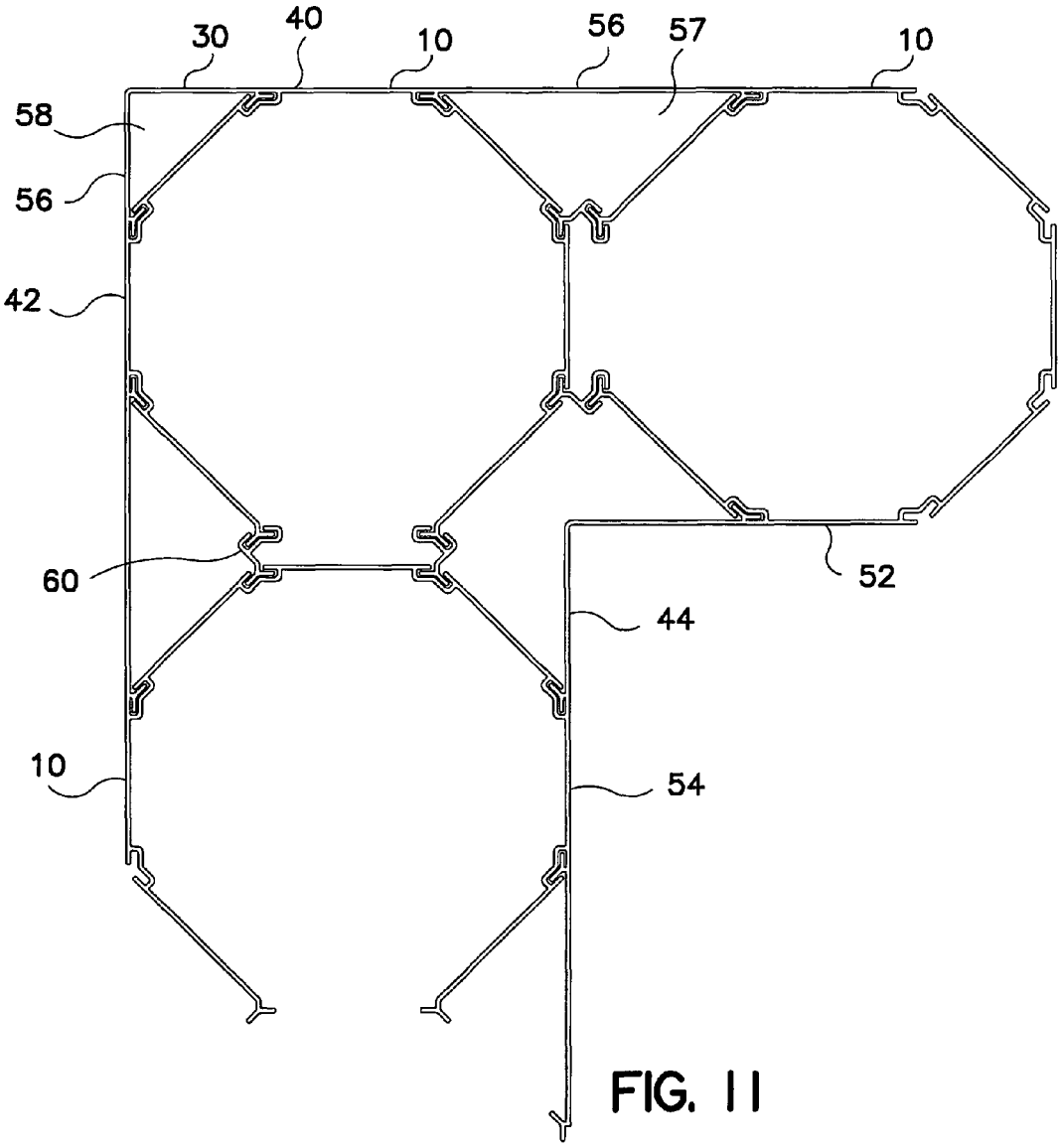
FIG. 11 shows an exemplary formwork section having the corner panels of FIGS. 9 and 10.

The corner panel 30 of FIG. 9 includes substantially perpendicular wall surfaces. The panel 30 permits the forming of flat corners. As shown in FIG. 11, the corner panel 30 permits the attachment of a corner portion to a form element 10 resulting in the extension of substantially perpendicular and substantially flat walls 40, 42. As shown in FIG. 11, the panel 30 can be used in forming the exterior of a formwork corner portion.

A corner panel can have other geometric shapes, such as a curvilinear wall surface or angled wall surfaces other than ninety degrees (e.g., at forty-five degrees).

FIG. 10 shows a corner panel 44 similar to corner panel 30. However, the corner panel 44 is adapted to engage two female engagement portions of adjacent form elements. The corner panel 44 has at least one end 46 with a male engagement portion 48 extending differently than the male engagement portion 34 of corner panel 30. In FIG. 10 the male engagement portion 48 is rotated approximate 180 degrees relative to the male engagement portion 34 of corner panel 30. The male engagement portion 48 can be of similar configuration and operation as the previously discussed male engagement portions. Thus, the male engagement portion 48 can comprise one or more of an engagement fin, projection, finger, or lip 50. FIG. 10 shows each end of corner panel 44 having identical male end engagement portions 48. The male engagement portions 48 are adapted to engage respective matching female engagement portions, such as those of a form element. As shown in FIG. 11, the corner panel 44 permits the attachment of a corner portion resulting in the extension of substantially perpendicular and substantially flat walls 52, 54. As shown in FIG. 11, the corner panel 44 can be used in forming an interior surface of a formwork corner portion.

An exemplary form of a formwork of the present invention can have identical male engagement portions with a common connection locus. Female engagement portions can likewise be identical and have a common locus.

Of course it should be understood that the male end engagement portions of respective wall panels and corner panels do not have to be identical but can have different male configurations. That is, the configurations of the male end engagement portions on a single wall panel can differ. Likewise, the configurations of the male end engagement portions on a single corner panel can also differ.

It should also be understood that the sizes (e.g., length, width, depth, etc.) of wall panels and corner panels can vary. That is, a formwork arrangement can include wall panels of different sizes and corner panels of different sizes.

Also, it should be understood that the surfaces of wall panels and corner panels (and form elements) can be corrugated. Corrugation can be used to increase strength and/or flexibility. Other shapes can include rolled, stippled, curved, etc. Additionally, a formwork wall arrangement can have a custom shape. For example, a formwork wall arrangement can be flat on one side and corrugated on the other side. A wall structure can also be planar but the outer surface used can architecturally look rolled, corrugated, stippled, curved, etc.

A formwork profile can also be arranged to allow reduction in external hydrostatic pressure, such as in a below ground grade structure. Perforations 56, holes, openings, apertures, or similar structure can be provided in one or more panels (e.g., wall panels and/or corner panels and/or form elements). A formwork space or void or channel 57, 58 adjacent to and interior of an exterior panel, as shown in FIG. 11, can be fluidly connected to a drainage system. For example, such an arrangement can be used to remove water adjacent to a formwork wall structure. Water would be permitted to enter panel perforations, flow downward inside the void toward a footer, and then be drained away from the wall structure by the drainage system. Such an arrangement can also protect from moisture products that can be stored inside of an enclosure having the perforated wall structure. An arrangement using perforations can also be used to provide continual air and/or water vapor flow through any of the void spaces, such as in vegetable storage facilities. Void spaces defined by adjoining form elements and a wall panel or a corner panel can serve as a conduit of fluid ingress or egress to provide air, moisture, or other fluid into or out of a structure's interior. For example, certain crops such as potatoes may require airflow to prevent spoilage. Any of such void spaces can be connected to a forced-air system to cause airflow from the spaces into the interior space. Alternatively, void spaces adjoining the exterior of the structure can have perforations to permit equilibration of hydrostatic pressures between the exterior and the interior of the structure.

Other formwork arrangements can be used with products to provide long term assurance of a substantially dry internal environment. For example, a TPE seal or other water proofing systems and/or sealers can be used to keep out water. The exterior walls of a concrete filled formwork structure can include water absorbing products, such as bentonite, therein or as a separate layer thereon.

Other exemplary forms of formwork arrangements can have increased concrete strength through retaining the water of hydration. Formwork arrangements can also permit use of high flow concrete to reduce construction costs. It should also be understood that a form work of the present invention is not limited to use with concrete or cement, but can be filled with insulation, rebar, air, earth, and/or temporary filling material.

Figure 12:
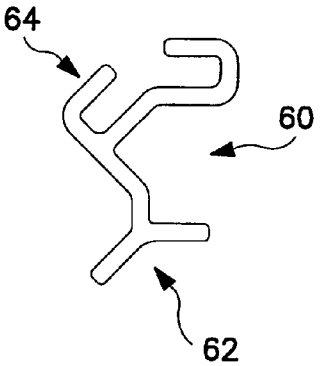
FIG. 12 shows an exemplary external joint connector.

FIG. 12 shows an exemplary external joint filler or connector 60. The external joint connector includes both a male engagement portion 62 and a female engagement portion 64. The male engagement portion 62 and the female engagement portion 64 can be of similar configuration and operation as the previously discussed male and female engagement portions. The external joint connector can be used to fill in gaps to permit an engagement or interconnection, such as engagement of adjacent form elements. FIG. 11 shows an example of an external joint connector 60 in operative connection. For example, the open end of a form element can be attached or fastened to a closed face of an adjacent form element using an external joint connector 60. As can be seen in FIG. 11 an external joint connector can extend substantially externally of or between adjacent form elements. An external joint connector can employ many features. For example, an external joint connector can be operative to facilitate a change in direction or the meeting of two form elements. An external joint connector can also be used to adjust the length of a wall. External joint connectors can also be used in the creation of curved walls. For example, more external joint connectors can be located in a first form work section than in a second formwork section to create a deviation or curvature. One way to form a curvature is to create an unequal number of external joint connectors of the interior vs. the exterior plane of the structure. [Add Drawing(s) from Manual] Additionally, joints of male/female engagements can purposely (or inadvertently) be opened, such as during the assembly or construction process, to gain temporary access to the inside of the formwork. The structure of an external joint connector permits its use in the reconnection of previously opened joints. That is, one or more external joint connectors can be employed in the resecuring of previously opened joints.

Figure 13:
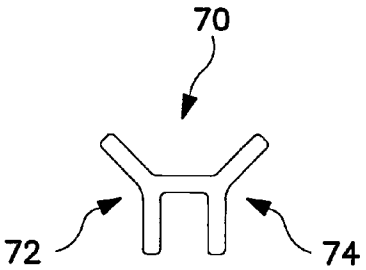
FIG. 13 shows an exemplary internal joint connector.
Figure 14:
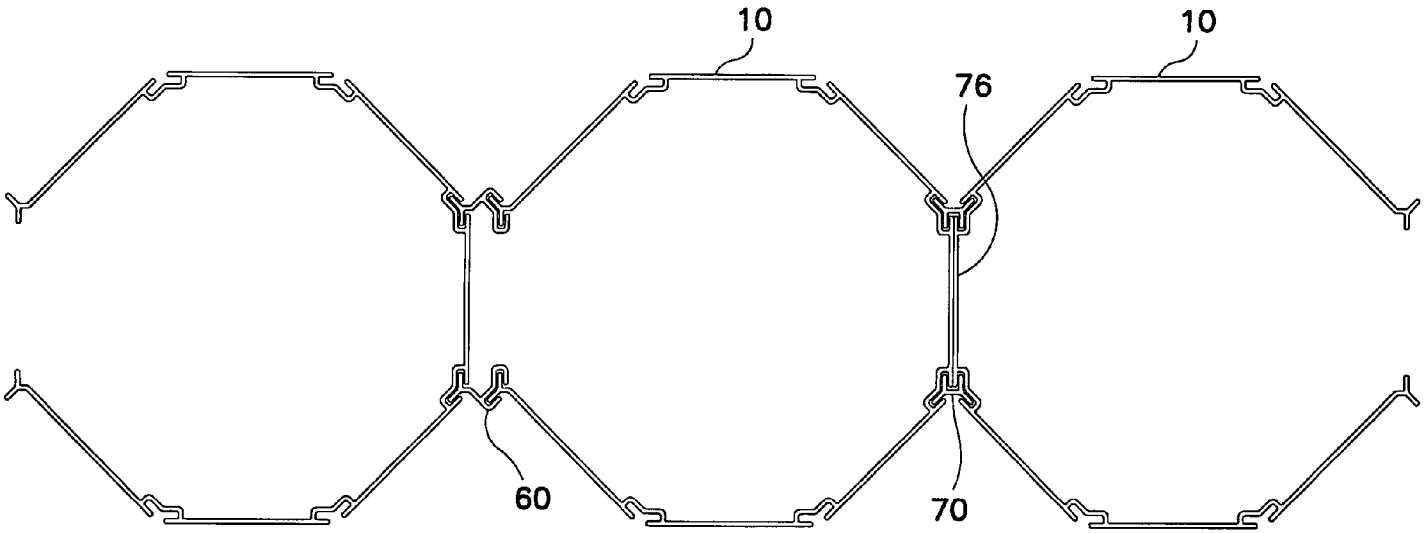
FIG. 14 shows an exemplary formwork section having an external joint connector and an internal joint connector.

FIG. 13 shows an exemplary internal joint filler or connector 70. The internal joint connector includes two male engagement portions 72, 74. The male engagement portions 72, 74 can be of similar configuration and operation as the previously discussed male engagement portions. The internal joint connector can be used to permit engagement, such as engagement of adjacent form elements. FIG. 14 shows an example of an internal joint connector 70 in operative connection. For example, a closed face of a first form element 10 can be engaged, attached, fastened, or operatively connected to a closed face of an adjacent second form element 10 using an internal joint connector 70 resulting in a double walled portion 76. As can be seen in FIG. 14 an internal joint connector can remain substantially internal of or enclosed between adjacent form elements. In comparison with an external joint connector 60 an internal joint connector 70 can extend a lesser extent. An internal joint connector employs many features. For example, an internal joint connector is operative to connect two adjacent female engagement portions, such as when rotation of form elements or a change in assembly direction is required.

The exemplary joint connectors 60, 70 make possible many procedures, such as the unzipping of a wall section for access to interior reinforcement; the repair of a joint; the increasing of a wall length section; the creation of deviations or curvatures, the joining of similar sex components; the easier corner installation of rebar; the erection of wall sections when weather is not optimal or wall sections are very long; and the resecuring of previously opened joints.

Figure 15:
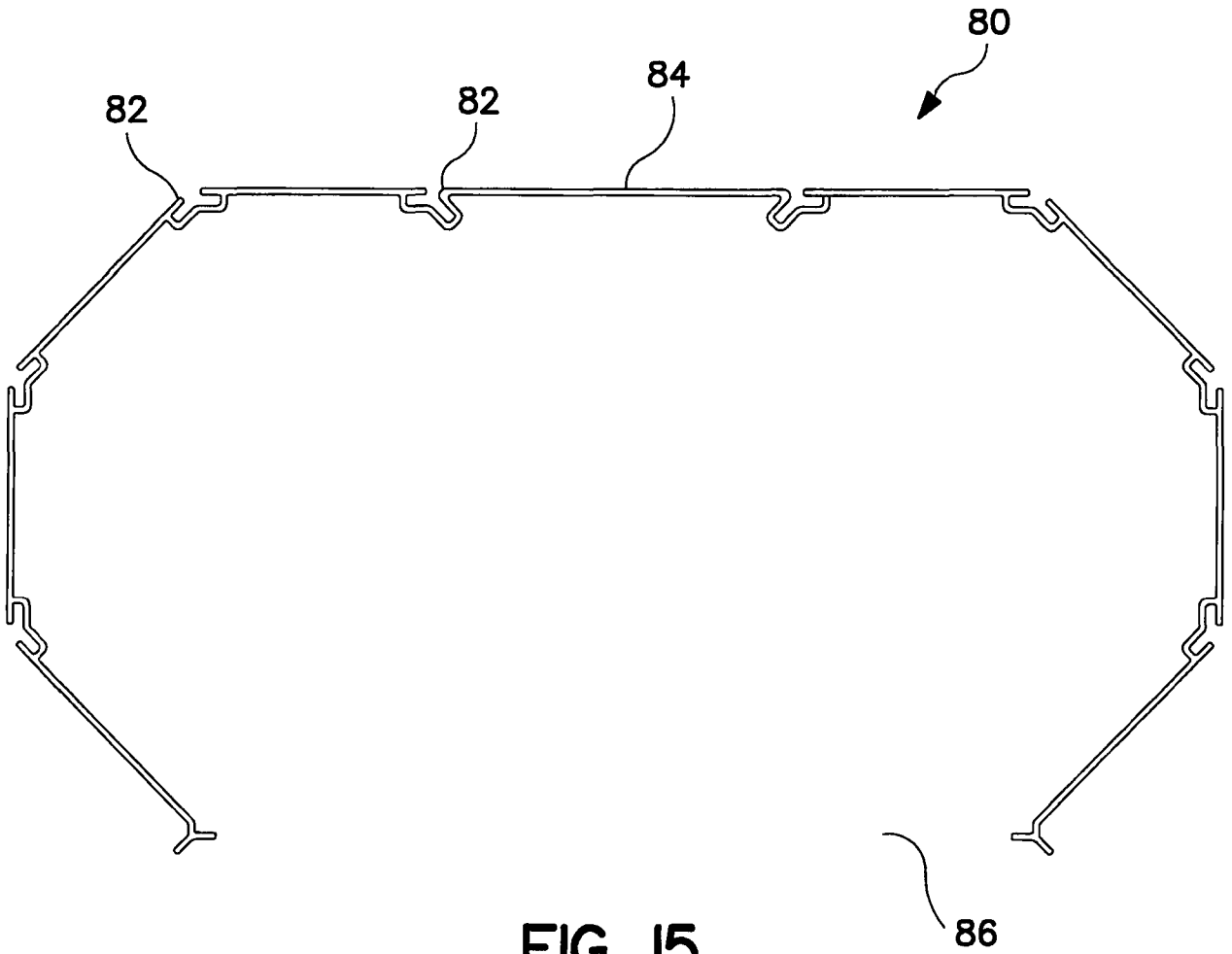
FIG. 15 shows an exemplary elongated form element.
Figure 16:
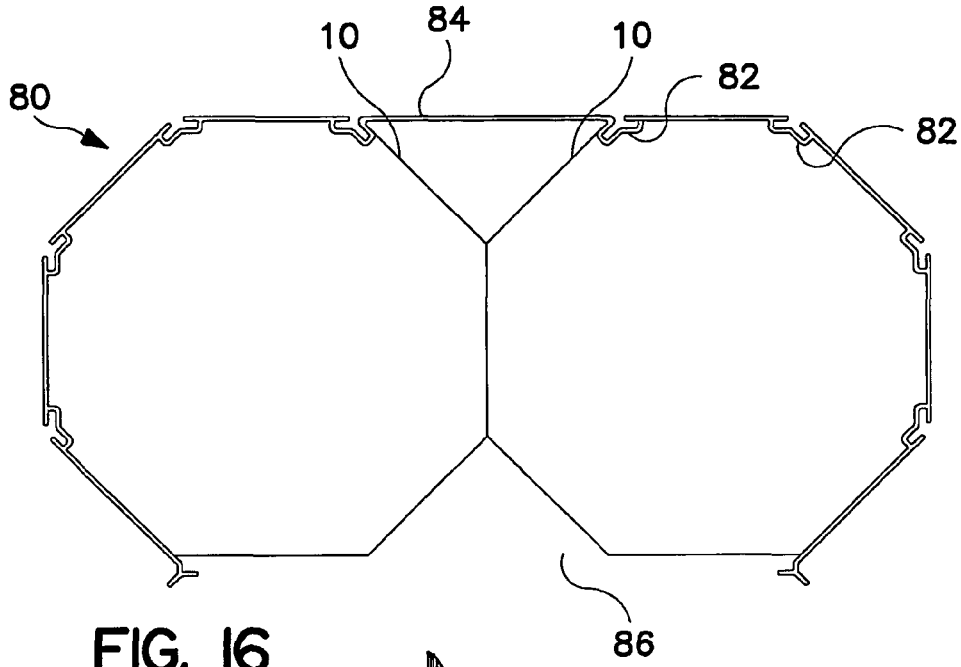
FIG. 16 shows an exemplary octagonal elongated form element with the outline of two octagonal regular form elements.

Form elements can also be of elongated shape. FIG. 15 shows an exemplary form element 80 of elongated octagonal shape. The form element 80 can be elongated in cross section and longitudinal direction. An elongated form element 80 can be substantially equal to twice the (cross sectional) thickness of previously discussed (regular) form elements 10. That is, an elongated form element 80 can be substantially twice as wide in cross section as a form element 10. A comparison of an elongated form element 80 with the outline of two form elements 10 is shown in FIG. 16. FIG. 16 shows a comparison of an octagonal elongated form element with the outline of two octagonal (regular) form elements. A formwork assembly can include both regular form elements and elongated form elements. It should be understood that an elongated form element can be a multiple of two regular form elements.

Elongated form element 80 also includes female portions 82. A leading or back wall 84 extends opposite an open face 86. The leading wall 84 also includes female portions (82). As shown in FIG. 16, the leading wall 84 has a length substantially equal to the length of two faces of form element 10 plus the length of the gap there between (e.g., the length of a previously discussed wall panel, e.g., panel 22).

Of course elongated form elements can be of greater or lesser thickness than shown in FIG. 15. For example, an elongated form element can be triple the thickness of (regular) form elements 10. Additionally, an elongated form element can be one and a half times the thickness of form elements 10. That is, an elongated form element can be of an integer, fraction, or particular size relative to other form elements to enable a completed formwork to meet a particular design profile. Use of an elongated form element can permit a reduction in the number form elements needed in a formwork assembly. Thus, use of an elongated form element can result in cost savings of assembly time. An elongated form element can also be used to ensure a coordination of corner aesthetics. A strong corner section can be obtained with use of elongated form elements.

Figure 17:
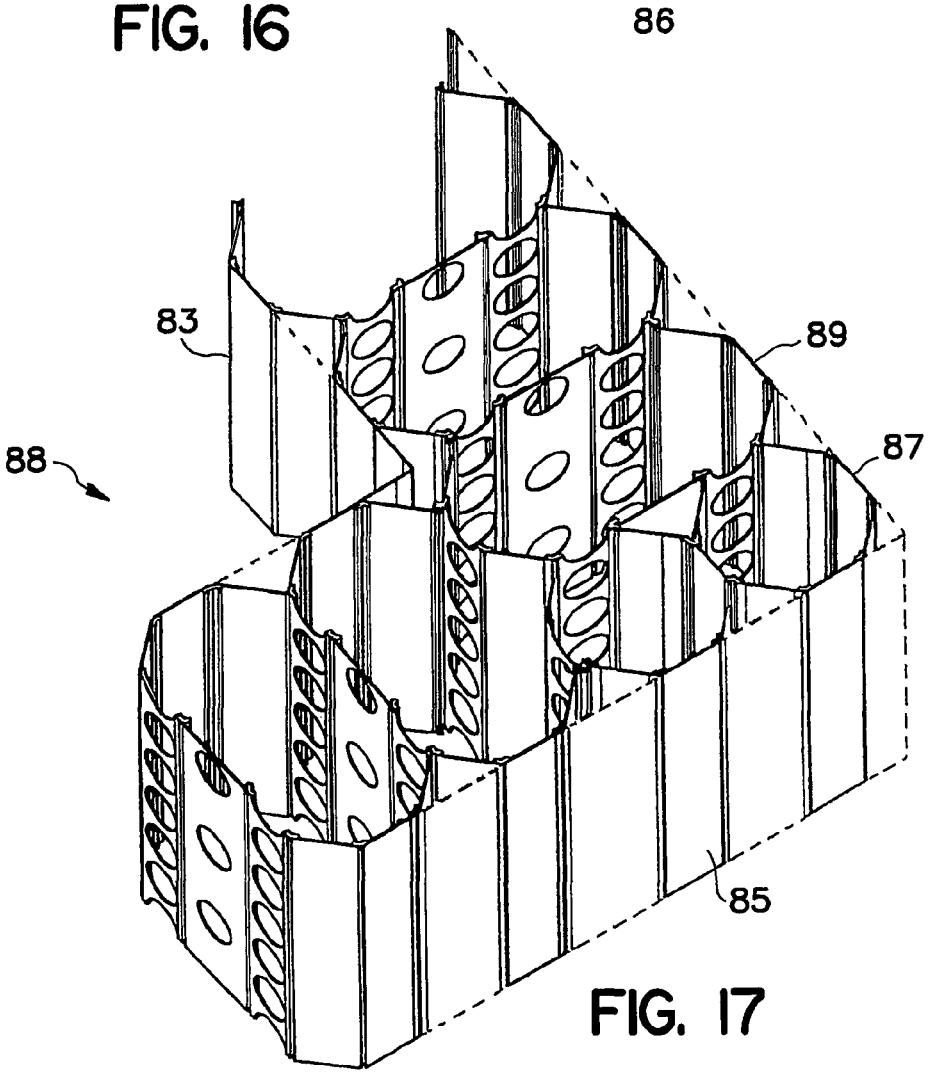
FIG. 17 shows an angled view of a cut away portion of an exemplary formwork arrangement.

FIG. 17 shows an angled view of a cut away portion of a formwork arrangement 88 having form elements 87, elongated form elements 89, and other formwork components, such as wall panels and corner panels, resulting in substantially flat interior and exterior wall surfaces 83, 85.

Figure 18:
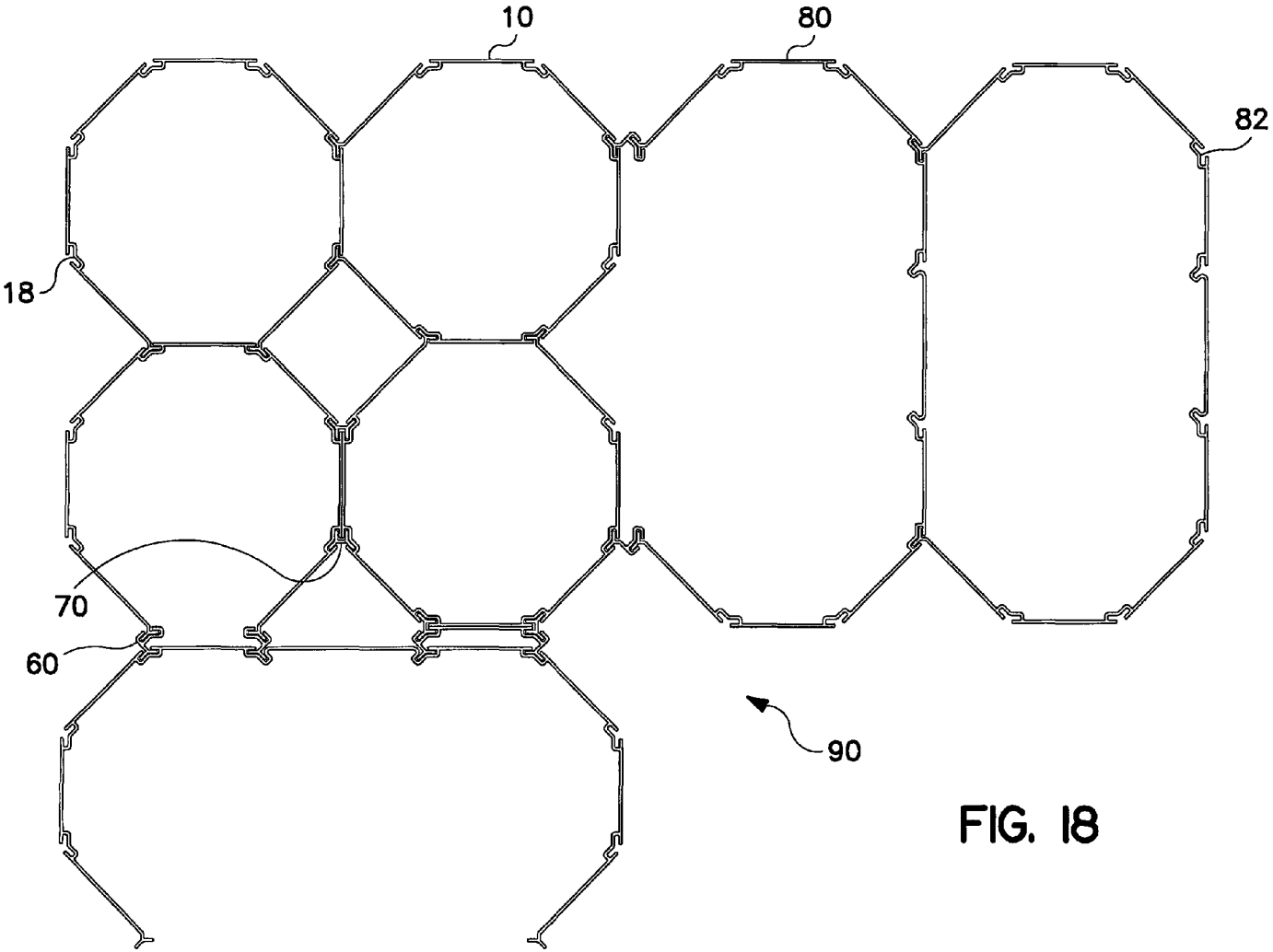
FIG. 18 shows an exemplary formwork section having form elements, elongated form elements, external joint connectors, and internal joint connectors.

FIG. 18 shows a portion or section of a formwork 90 including form elements 10, elongated form elements 80, external joint connectors 60, and internal joint connectors 70. The arrangement can provide a strong corner section, especially as the wall system increases.

Figure 19:
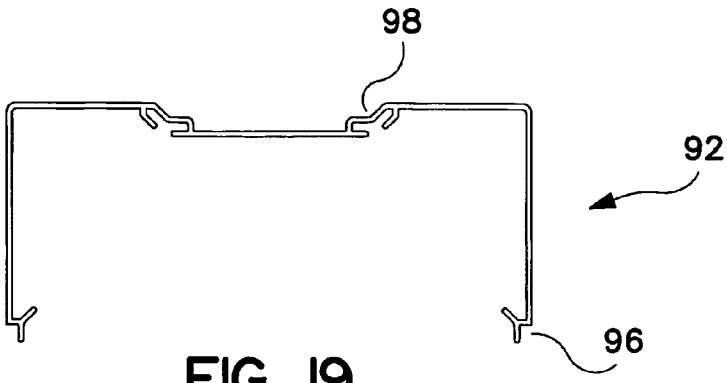
FIG. 19 shows an exemplary buck panel adapted for engagement with a form element.
Figure 20:
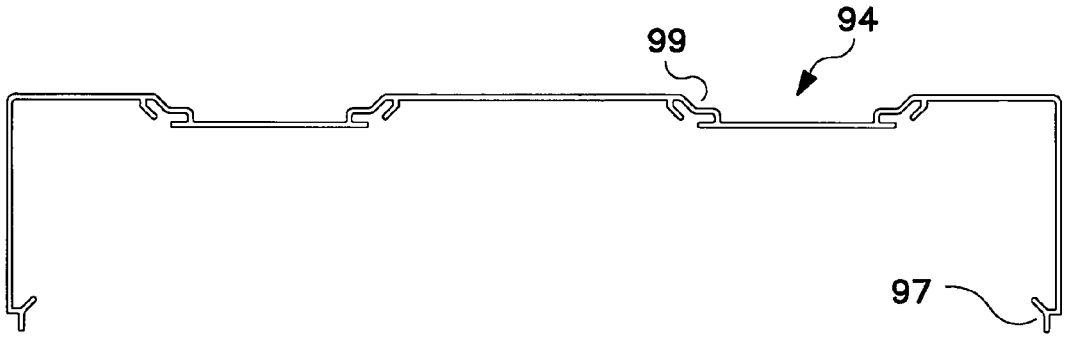
FIG. 20 shows an exemplary buck panel adapted for engagement with an elongated form element or with two form elements.

FIG. 19 shows a buck panel 92 adapted for engagement with a form element 10. FIG. 20 shows a buck panel 94 adapted for engagement with an elongated form element 80 or with two form elements 10. The buck panel 92 includes a pair of male engagement portions 96. The buck panel 94 includes a pair of male engagement portions 97. A buck panel is adapted to close an open side of a form element. In such a closure, the buck male portions can mate with the form element female portions nearest the opening. A buck panel can also be attached to other form element walls. For example, a buck panel can be placed adjacent the back wall (e.g., the wall opposite the open side) of a form element 10. In such a placement the buck panel would enclose the back wall and the two walls adjacent to the back wall. Buck panels can be configured in various sizes for use with form elements 10 and elongated form elements 80. A buck panel can also include female engagement portions adapted to receive corresponding male engagement portions, such as form element male engagement portions or other formwork component male engagement portions. The buck panel 92 of FIG. 19 includes a pair of female engagement portions 98. The buck panel 94 of FIG. 20 includes two pair of female engagement portions 99. A buck panel can also be perforated to allow concrete flow when positioned.

FIGS. 21-24 show various cut away portions of buck panels 112, 114, 116, 118 connected to respective form elements 122, 124, 126, 128. As previously discussed, buck panels can be configured in various sizes for use with various sized form elements and elongated form elements.

To permit ease of formwork construction, the components of the formwork can all use the same type of male and female engagement portions. That is, the male engagement portions of the form elements, wall panels, corner panels, external joint connectors, and internal joint connectors can be of the same configuration or shape. Likewise, the form elements, wall panels, corner panels, external joint connectors, and internal joint connectors can have female portions of the same configuration which are operative to engagingly receive the respective matching male engagement portions.

Figure 25:
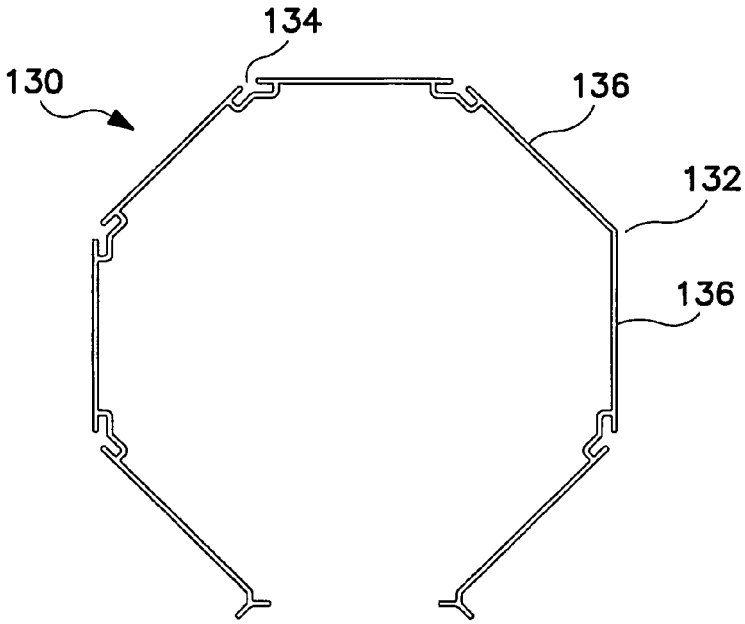
FIG. 25 shows an exemplary form element with a closed vertex.
Figure 21:
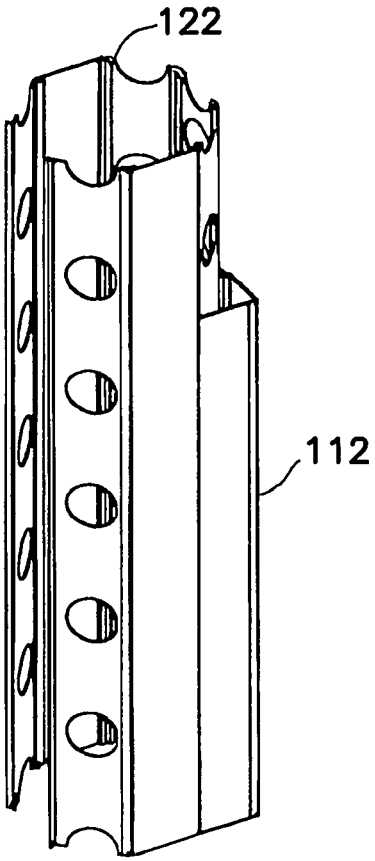
FIGS. 21-24 show various cut away portions of exemplary buck panels connected to respective form elements.
Figure 22:
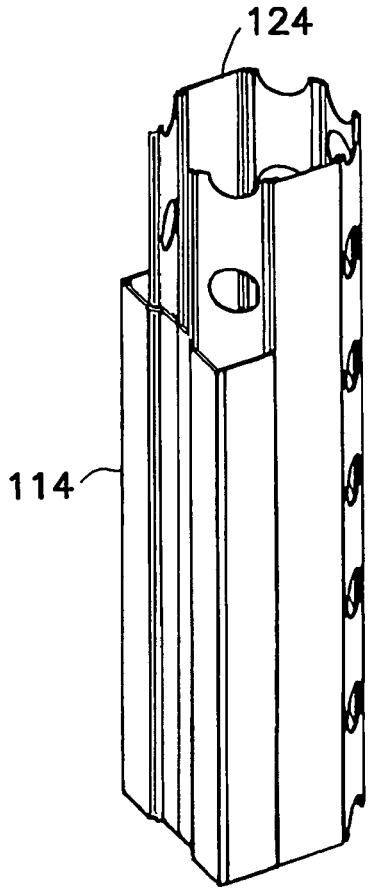
Figure 23:
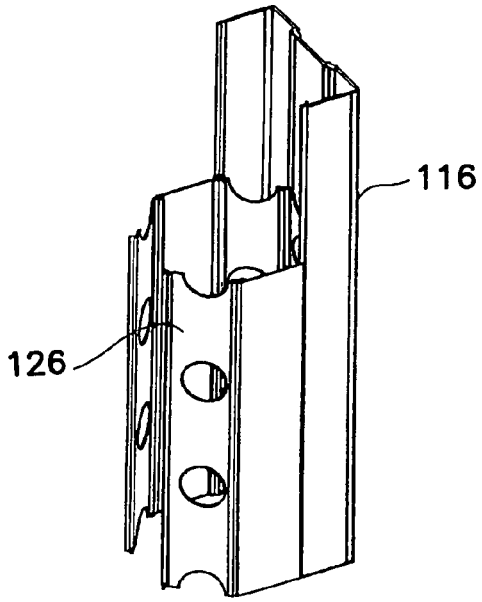
Figure 24:
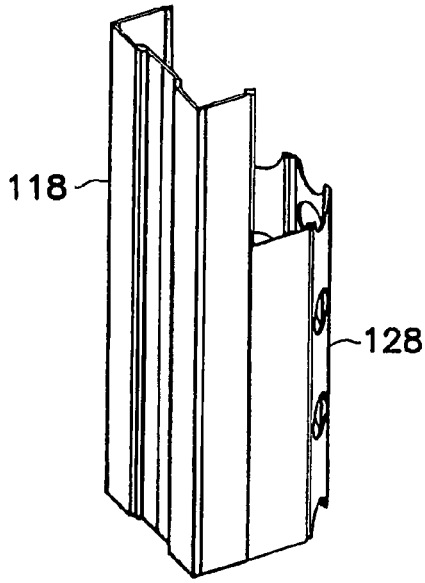
Figure 26:
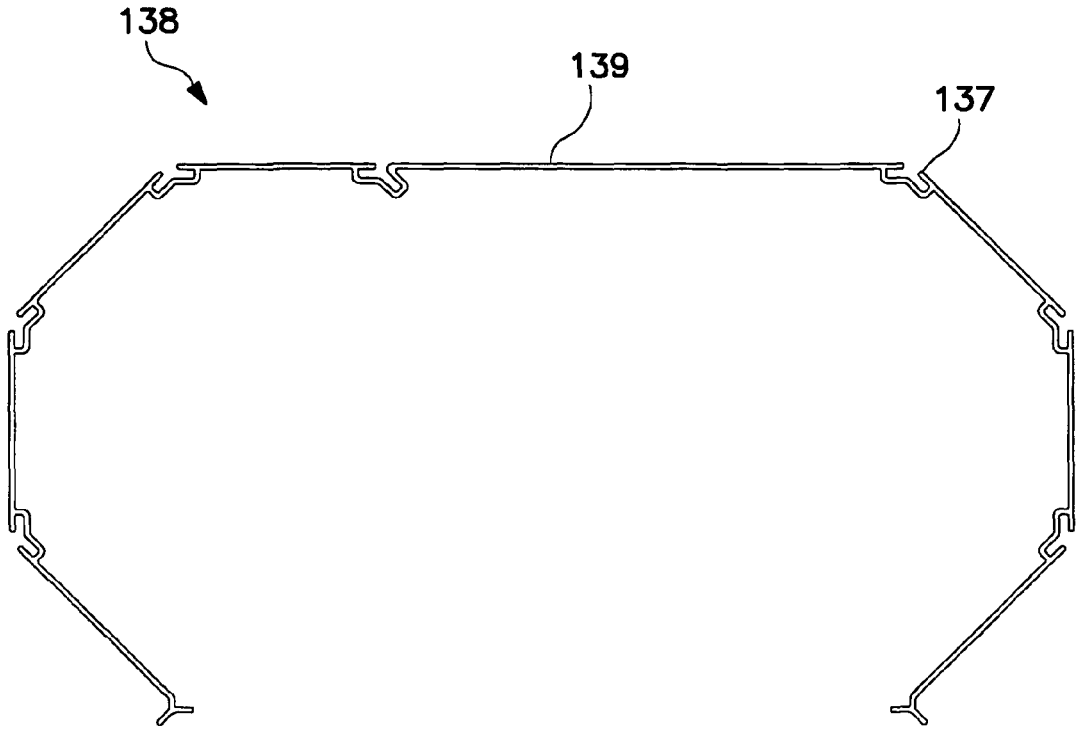
FIG. 26 shows an exemplary elongated form element absent a female portion at a wall.

Certain formwork arrangements can be without a female engagement portion at every possible female location of a form element. For example, certain vertices in an octagonal form element, which are deemed unnecessary for engagement purposes, can omit a female portion. That is, as shown in FIG. 25 two adjacent faces 136 of a form element 130 adjacent an apex or vertex 132 can be joined absent a female portion 134. Likewise, an elongated form element 138 can have one or more female portions 137 absent from a wall 139 thereof, as shown in FIG. 26. Still other arrangements with alternative female portions can be used. For example, a female portion can remain on a form element but the entrance thereto can be closed to a male portion. That is, adjacent walls of a form element can be joined in closing a female portion and preventing engagement with an outside male portion.

Figure 27:
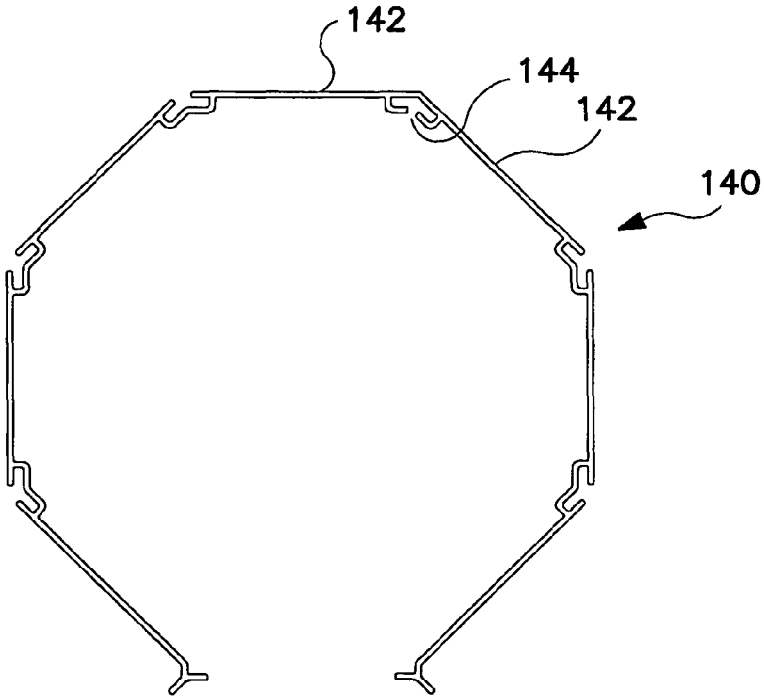
FIG. 27 shows an exemplary form element having a female portion closed to the exterior but open to the interior.
Figure 28:
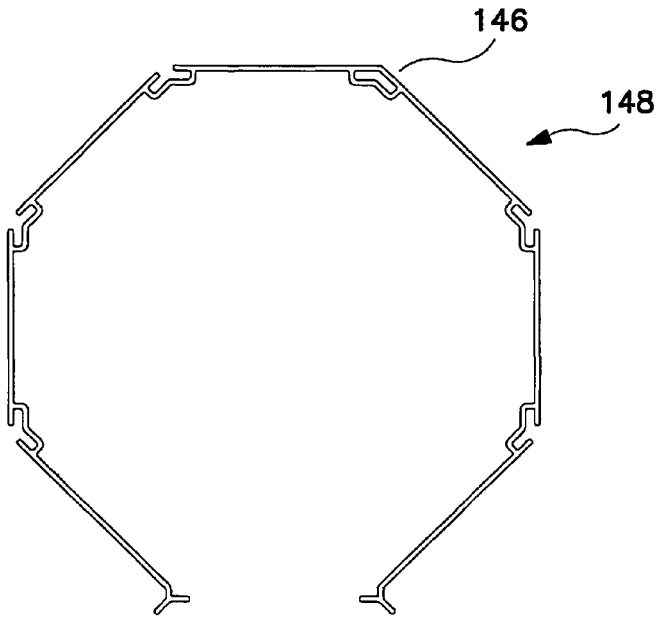
FIG. 28 shows an exemplary form element with a closed female portion inoperative to receive a male portion.
Figure 29:
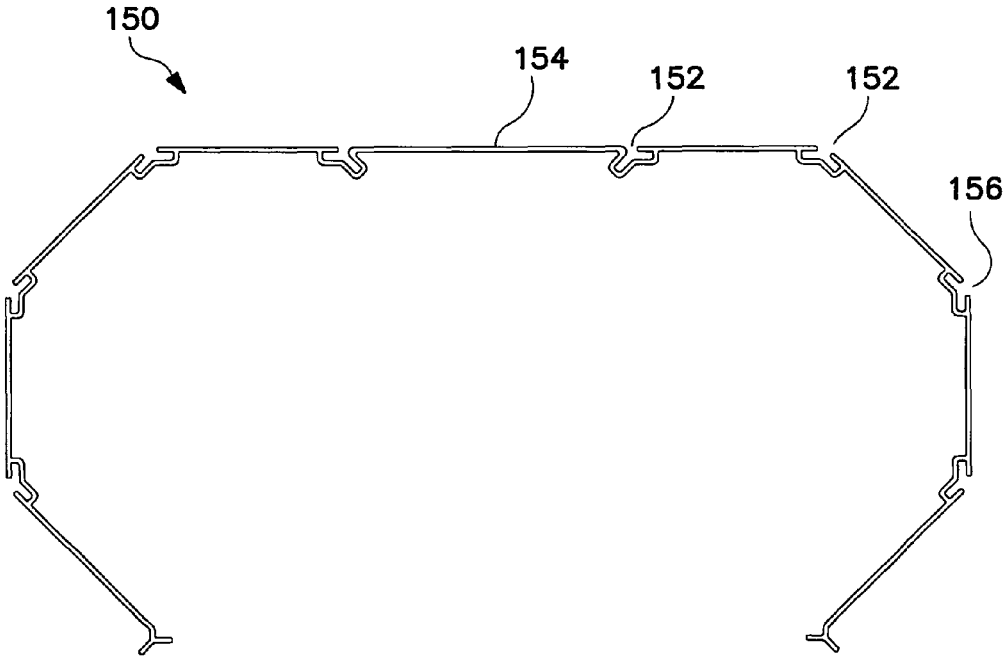
FIG. 29 shows an example of a closed female portion on a wall of an elongated form element.
Figure 30:
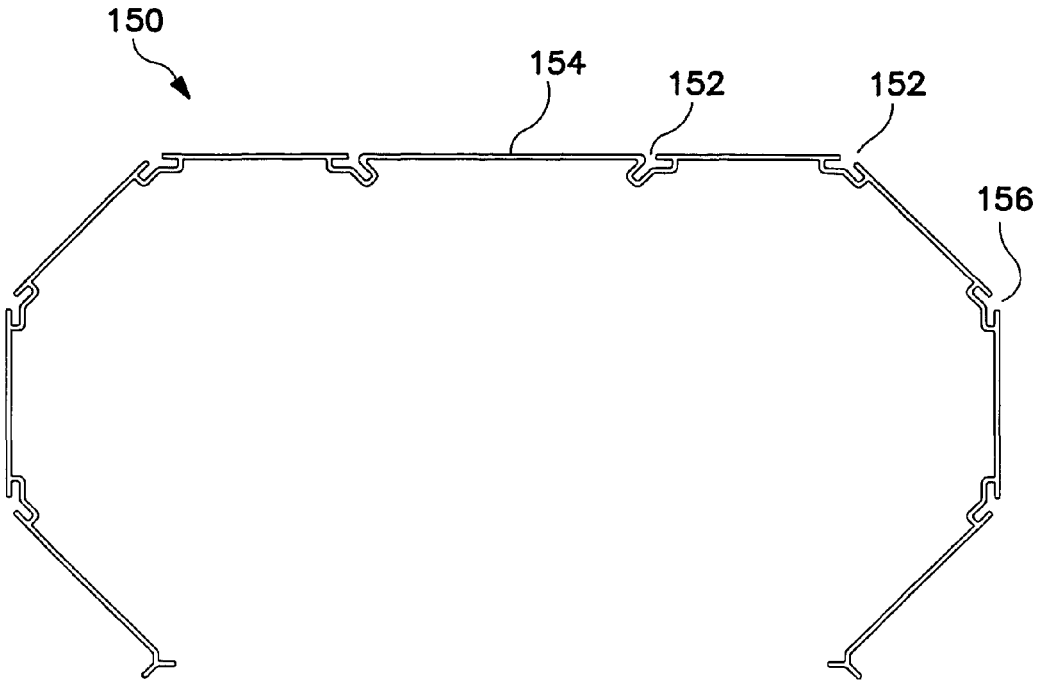
FIG. 30 shows another example of a closed female portion on a wall of an elongated form element.
Figure 31:
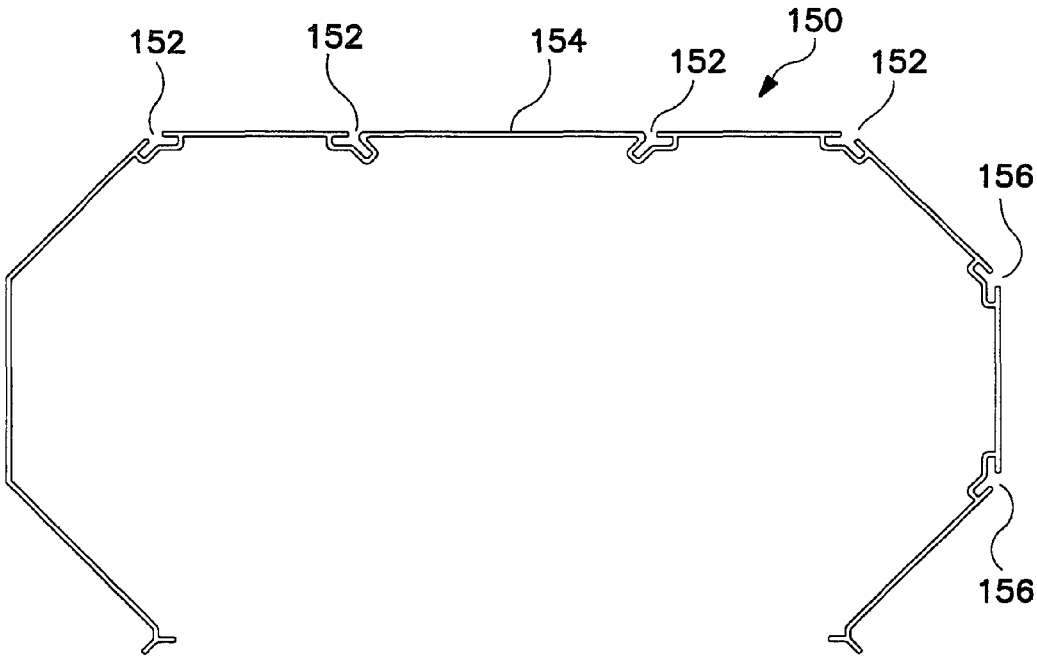
FIG. 31 shows a further example of a closed female portion on a wall of an elongated form element.

FIG. 27 shows two adjacent walls 142 of a form element 140 joined in closing a female portion 144 (or forming a closed female portion) and preventing engagement with an outside male portion. In FIG. 27 female portion material is reoriented to achieve the closure. The closed female portion is operative to receive a male portion from the interior of the form element. FIG. 28 shows a closed female portion 146 of a form element 148 in which additional material has been used in the closure. A filler strip can also be used to close a female portion. The closed female portion (146) of FIG. 28 is not operative to receive any male portion. Likewise, a wall or vertex of an elongated form element, instead of having an open female portion thereat, can have the female portion closed or absent. FIGS. 29-31 show examples of female portions 152 being either absent or closed on a wall 154 and/or at a vertex 156 of an elongated form element 150. The closure or absence of one or more female portions can be useful in producing a substantially smooth apex or wall, in easing a specific assembly process, and in reducing materials and costs. FIG. 29 shows a closed female portion of an elongated form element in a manner similar to FIG. 27. FIG. 30 shows a closed female portion of an elongated form element in a manner similar to FIG. 28. FIG. 31 shows closed and absent female portions associated with an elongated form element. Female portions can also be closed for aesthetic reasons. For example, an exemplary embodiment can have female portions closed at opposite corners but not along the engagement sides where a flat wall panel or a corner panel can be engaged.

Figure 32:
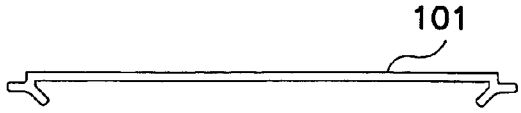
FIGS. 32-33 show a comparison of exemplary wall panels having similar configuration but different lengths.
Figure 33:
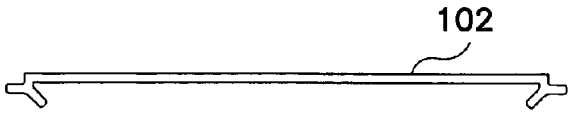

FIG. 32 and FIG. 33 are arranged adjacent each other to show a comparison of respective similar wall panels 101, 102. FIGS. 32-33 show that wall panels 101, 102 can be of similar configuration yet have different lengths. Wall panel 102 has a cross sectional length greater than that of wall panel 101. A formwork can use wall panels of different lengths, especially when both form elements and elongated form elements are involved. Wall panels can also be of similar configuration yet have different longitudinal (e.g., vertical) lengths.

Figure 34:
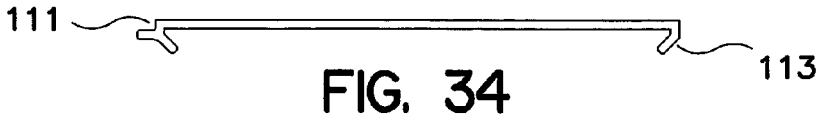
FIG. 34 shows an example of male engagement portion configurations of a wall panel.
Figure 35:
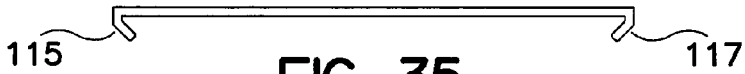
FIG. 35 shows another example of male engagement portion configurations of a wall panel.

FIGS. 34-35 show wall panels with alternative male engagement portion configurations. In FIG. 34 a first male engagement portion 111 has two fins while a second male engagement portion 113 has a single fin. In FIG. 35 each male engagement portion 115, 117 has a single fin, with each fin extending inward toward the other fin. Of course other alternative wall panel configurations can be used. For example, a wall panel can have each male engagement portion with only one (single) fin, with the first fin extending outward away from the second fin, and the second fin extending inward toward the first fin.

FIGS. 36-39 show additional panel arrangements that can be used when low strength formwork operations are permitted. For example, the panels of FIGS. 36-39 can be applicable with a formwork when the panels are not placed adjacent to poured concrete. These panels can also be used in testing or pre-viewing an assembly. That is, the panels of FIGS. 36-39 can be temporarily installed and then later removed.

Figure 39:
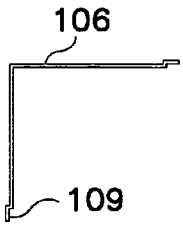
FIG. 39 shows a further example of a corner panel with a male engagement portion having an alternative configuration.
Figure 38:
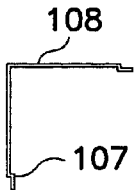
FIG. 38 shows an example of a corner panel with a male engagement portion having an alternative configuration.
Figure 37:
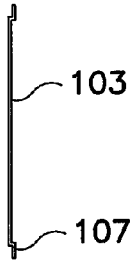
FIG. 37 shows a further example of a wall panel with a male engagement portion having an alternative configuration.
Figure 36:
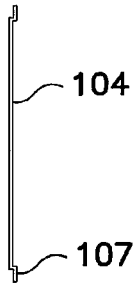
FIG. 36 shows an example of a wall panel with a male engagement portion having an alternative configuration.
Figure 41:
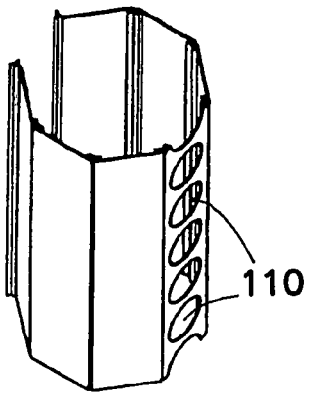
FIGS. 41-55 show examples of form elements having various aperture arrangements on form element wall portions.
Figure 42:
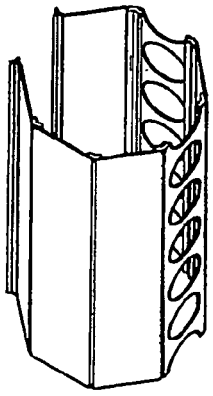
Figure 43:
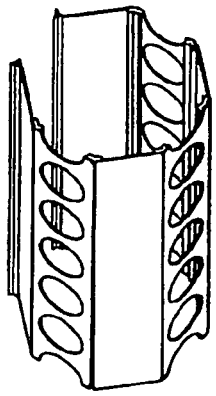
Figure 44:
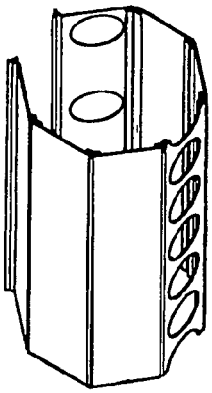
Figure 45:
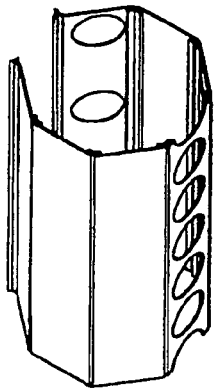
Figure 46:
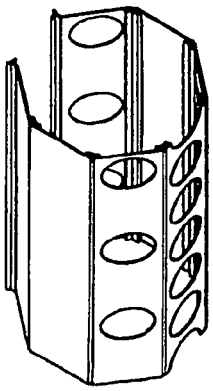
Figure 47:
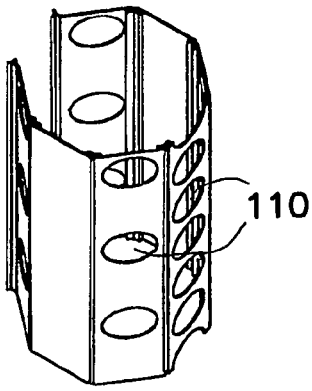

FIGS. 36 and 37 show comparison examples of different sized wall panels 103, 104. Wall panel 103 has a cross sectional length shorter than that of wall panel 104. FIGS. 38 and 39 show comparison examples of different sized corner panels 106, 108. Corner panel 106 is of a greater dimension than that of corner panel 108. FIGS. 36-39 also show a male engagement portion 107, 109 of an alternative configuration. The male engagement portion 109 protrudes in a manner opposite of the male engagement portion 107. These male portions are configured to engage only one side of the previously discussed T-shaped female portions. Thus, these male portions can provide less engaging contact then the previously discussed male portions. Alternatively, these male portions can be used with female portions of other configurations, such as a female portion having only one engagement side. For example, these male portions can have a fin of a L-shaped configuration. These male portions can also be of a greater length than shown. A female engagement portion can also have an alternative configuration (e.g., L-shape) to correspond to or match a L-shaped male fin.

Figure 40:
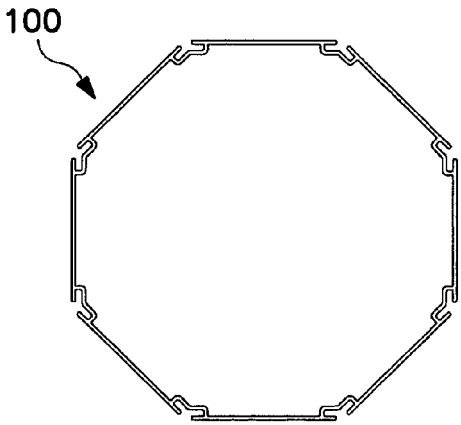
FIG. 40 shows an example of a form element having all sides closed.

As previously discussed, a form element can have various shapes in cross section. Form element walls can be substantially of equal length and positioned at substantially equal angles forming a substantially C-shaped cross section. In other exemplary embodiments a form element can have walls not of substantially equal length and positioned not at substantially equal angles. Form elements can also be without an open end, be circular, or be O-shaped. For example, an octagonal form element having eight walls without an open face, such as shown in FIG. 40, can also be used in alternative embodiments. The form element 100 of FIG. 40 has all sides or faces closed. That is, the form element includes female engagement portions but lacks an open face and male engagement portions. A formwork arrangement including a form element without an open face can be useful in forming a column (e.g., hollow or solid).

The form elements and panels can include apertures to permit fluid communication between adjacent chambers in the interior of a formwork. An example of formwork components that use apertures is shown in U.S. Pat. No. 5,216,863 the disclosure of which is incorporated herein by reference. The formwork components can be interconnected so that concrete is permitted to freely flow through apertures and into adjacent chambers. FIGS. 41-55 show examples of form elements having various aperture arrangements, including apertures 110, on the form element wall portions. As shown, both regular and elongated form elements can include apertures.

Figure 48:
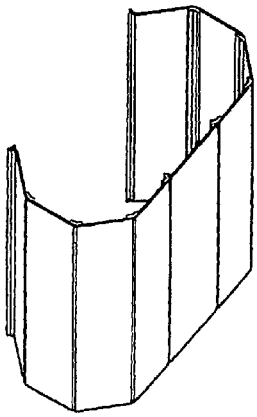
Figure 49:
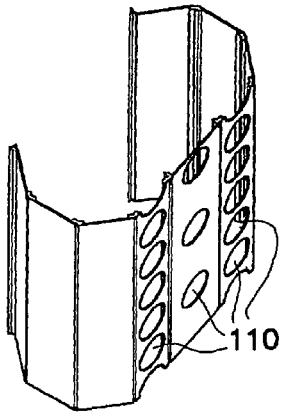
Figure 50:
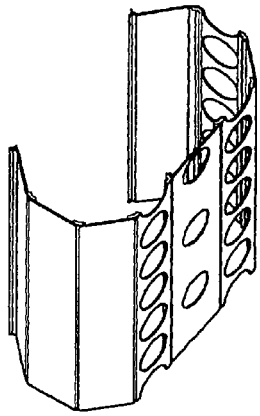
Figure 51:
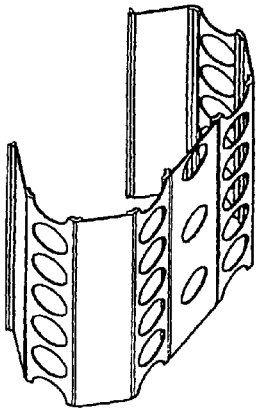
Figure 52:
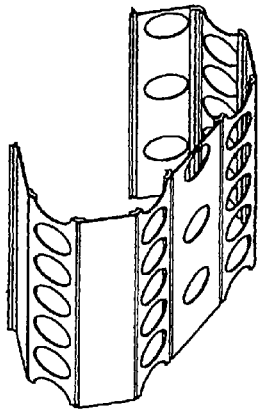
Figure 53:
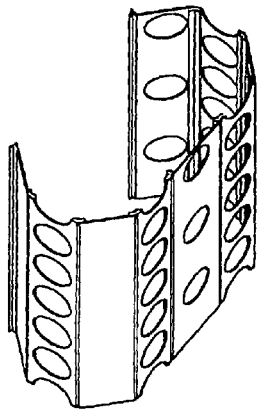
Figure 54:
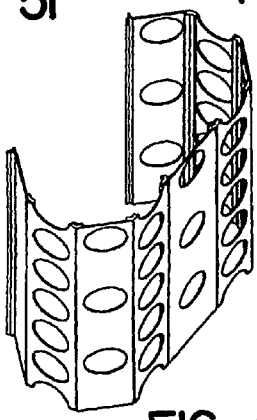
Figure 55:
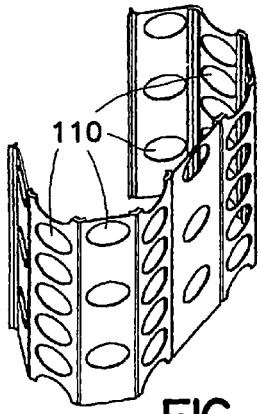

FIG. 48 shows a form element without apertures. FIG. 55 shows a form element with each face having apertures 110 associated therewith.

Apertures can also be arranged to permit concrete to flow into the spaces or chambers intermediate form elements 10, 80. For example, the cross-sectional triangular open area or channel 24 shown in FIG. 7 can have access to concrete via flow apertures in one or more form elements or units. It should also be understood that apertures can be of various sizes and/or flow areas. Apertures can also be of various cross sectional shapes, such as circular, oval, and rectangular. The apertures can have predetermined diameters or flow areas to permit a predetermined amount of concrete to flow therethrough. The same form element can have different sized apertures of different shapes. An assembled formwork or frame is adapted to retain poured concrete. The hardened concrete can result in a wall formed of a number of fused concrete columns. The concrete wall can become integral or fused with the formwork frame. The hardened concrete wall can include the formwork. Thus, the exposed exterior portions of the wall can comprise the formwork material. That is, the concrete can be surrounded by and protected by the formwork material. Thus, it is the formwork material that can be subject to the exterior circumstances, such as the weather.

Furthermore, reinforcement members such as rebar can be placed through concrete flow apertures to provide additional structural integrity or strength. Additionally, reinforcement members such as rebar can use different sized other apertures or perforations for their support. Such perforations can necessarily be operative to not permit concrete to flow therethrough. That is, such perforations can be primarily designed to achieve a close fit with the rebar. Thus, concrete can or cannot be permitted to seep through such rebar perforations. Additionally, apertures can be arranged to permit the insertion of cable therethrough. For example, reinforcement cabling can be used with cylindrical structure, such as circular tanks. Furthermore, glass fibers and/or metal fibers can be used in place of rebar. Structure which can serve a similar functionality as rebar can be used.

Also, apertures or perforations can be provided on exterior components of a formwork assembly. For example, a form element, wall panel, corner panel, and/or buck panel can include concrete flow perforations to permit a predetermined amount of concrete to flow therethrough to the exterior (or interior) of the formwork. Such exposed concrete can be used to attach other structures, such as a finish, to the concrete wall. For example, bricks, block, stucco, siding, drywall, wood, paneling, advertising, and/or other material can be attached to or bonded with the wall by associating with the exposed concrete. Additionally, a second formwork can be attached to an adjacent first formwork by using exterior (or interior) concrete flow perforations in at least one of the formworks. Thus, individual formwork arrangements can be attached or fixed to each other with concrete from passing through concrete flow perforations. Furthermore, multiple individual formwork wall sections, which can be adjacent and parallel to each other, can be linked side by side to create a very thick wall section. Thus, a concrete wall can be formed of several thicknesses, such as two or more times the normal thickness. For example, a four-wide wall thickness in the running direction can be used to increase strength and/or horizontal surface area.

The material of a formwork of the present invention can include known formwork materials. Additionally, a formwork can include a plastic or vinyl, such as polyvinylchloride ("PVC"). For example, in an exemplary embodiment, all of the formwork components, such as form elements, panels, and connectors, can comprise PVC. It should also be understood that a formwork can use non-PVC polymers, such as nanoclay PP, industrially recycled thermoplastic polymers, etc. Furthermore, formwork components can include selective metal components, which can provide additional strength. Metal can be incorporated or embedded in a formwork component.

FIGS. 56-59 show examples of formwork sections containing insulation. A formwork of the present invention permits usage with a variety of insulation types and forms. For example, applied insulation can comprise segments, blocks, slurry, blown-in particles, etc.

Figure 56:
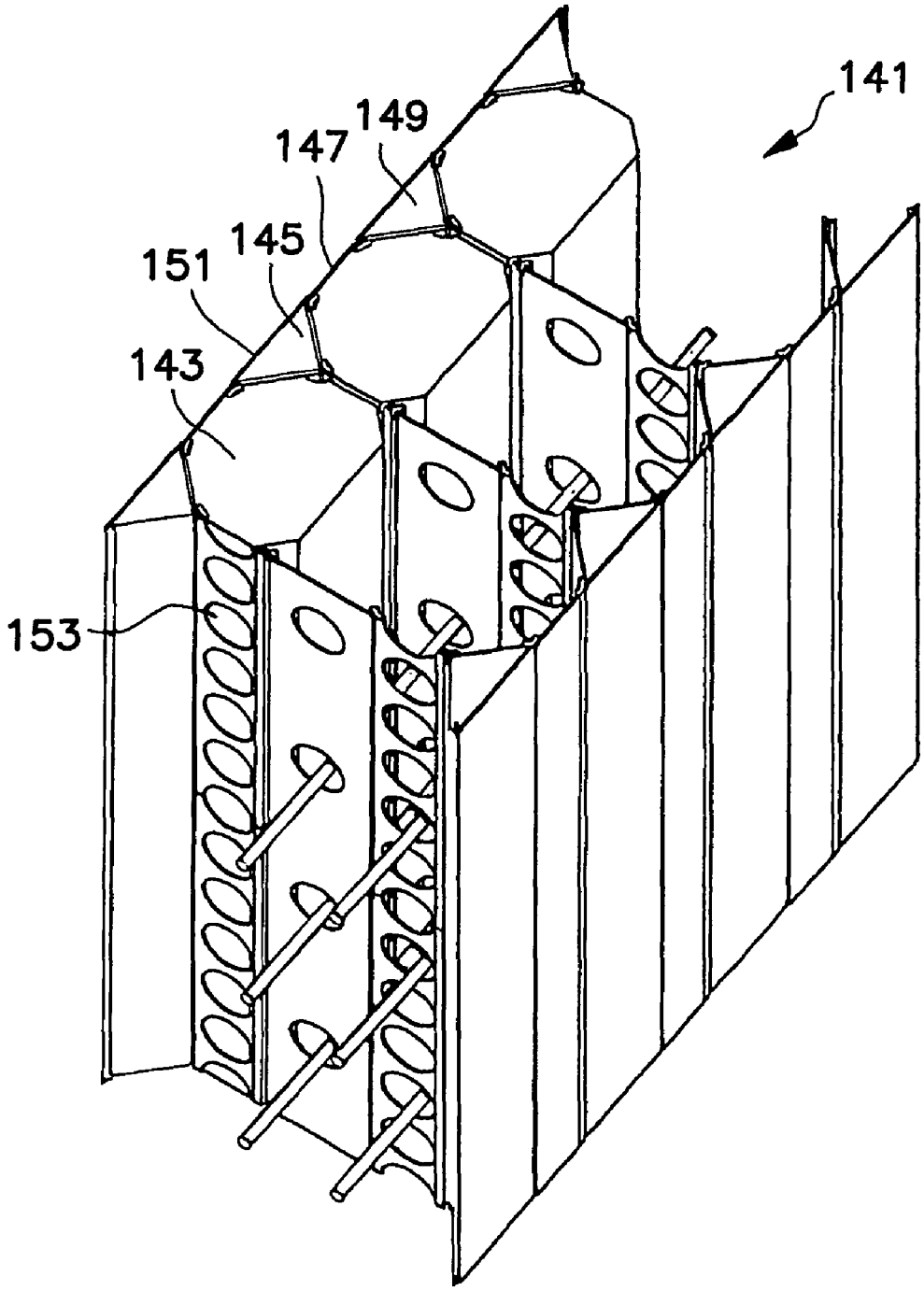
FIGS. 56 and 57 show examples of formwork sections containing insulation.

FIG. 56 shows a formwork arrangement 141 with insulation 143, 145. Insulation is shown adjacent one (exterior or interior) side of a formwork section. Insulation can be in both a form element chamber portion 147 and a triangular portion 149 adjacent a wall panel 151. Insulation can also be in a chamber portion that has apertures 153 associated therewith.

Figure 57:
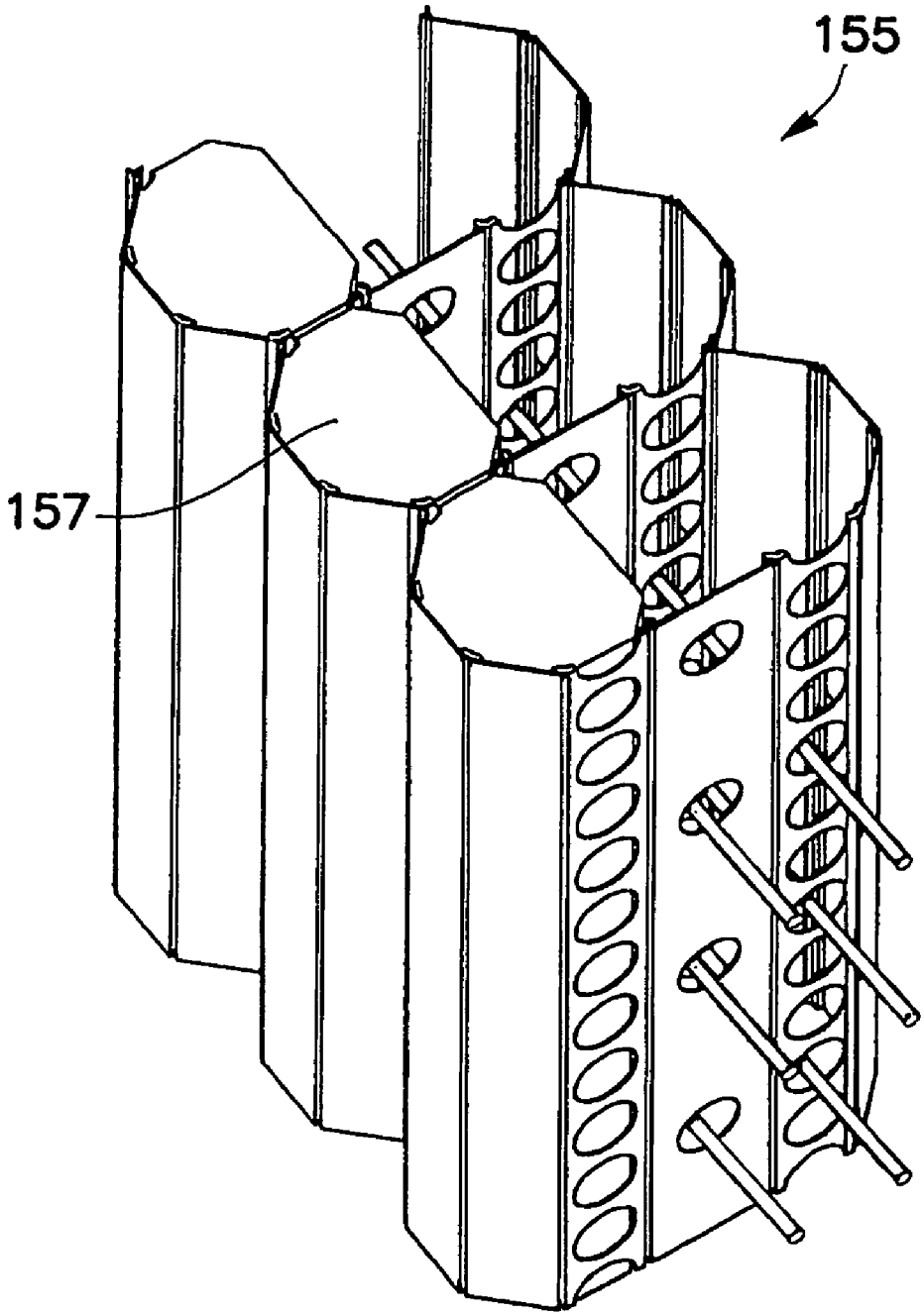

FIG. 57 shows a formwork arrangement 155 with insulation 157 in form element chamber portions. The insulation is shown on a side of center-positioned rebar. Insulation can be located on both sides of rebar. Other insulation arrangements can have entire form elements filled with insulation. Further insulation arrangements can have rebar extending through insulation.

Figure 58:
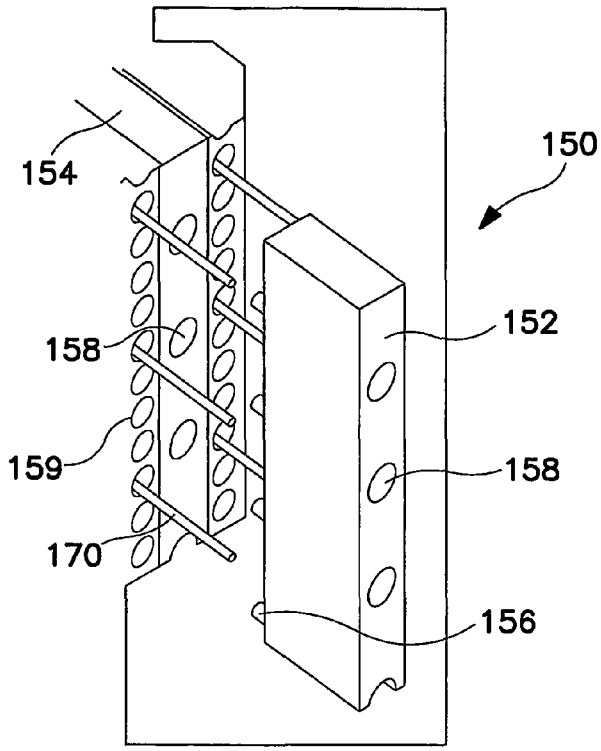
FIGS. 58 and 59 show further examples of formwork sections containing insulation.
Figure 59:
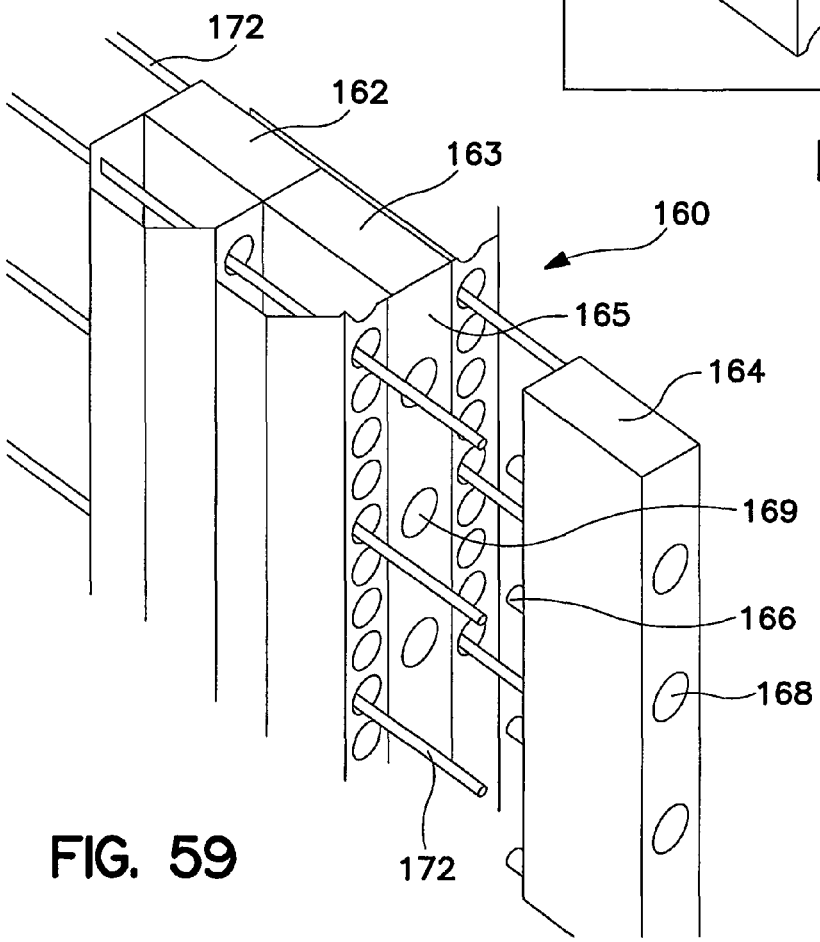

FIGS. 58-59 show examples of formwork sections containing alternative insulation arrangements. The insulation can be comprised of blocks or sections. One or more blocks of insulation can be attached using interengaging projections and recesses in a LEGO® block type of attachment arrangement. FIG. 58 shows a formwork arrangement 150 with insulation blocks 152, 154. The attachment arrangement permits a second block 154 to be engaged and aligned with a first block 152. An insulation block can have a male portion and a female portion. FIG. 58 shows a male portion including a projection 156 and a female portion including a projection receiving recess or opening 158. The male projection is adapted to be received in the female opening. Formwork apertures 159 are also shown. Corresponding male and female portions can be of various shapes and sizes. The male projection and a female opening can permit adjacent insulation blocks to directly contact and abut each other, such as in FIG. 58.

FIG. 59 shows a formwork arrangement 160 with insulation blocks 162, 163, 164. The attachment arrangement permits insulation blocks to be engaged and aligned. FIG. 59 shows a block male portion including a projection 166 and a block female portion including a projection receiving opening 168. A male projection and a female opening can be aligned with a formwork aperture or opening 169, e.g., a form element aperture, so that the male projection 166 extends through the aperture 169 while in engagement or connection with the female opening 168, such as in FIG. 59. That is, a male projection 166 and a female opening 168 can permit a form element wall 165, or some other form work component portion, to be located therebetween while in engagement with each other. Hence, a form element aperture 169 can assist in supporting and/or aligning insulation sections. As shown in FIGS. 58-59, insulation segments can be of a size which allows them to be positioned between or interior of reinforcement members 170, 172 such as rebar. As seen in FIG. 59, concrete can be placed between the insulation and an exterior or side of a form element. That is, the insulation arrangement permits concrete to be located in contact with the rebar.

A formwork can include block type insulation segments at a center or interior portion thereof, as shown in FIGS. 58-59, and other forms of insulation at exterior portions thereof. Alternatively, block type insulation segments can be used at exterior portions of a formwork. Such insulation can have interengaging projections and recesses or can have other devices for holding such blocks in position. Block insulation at formwork exterior portions can be engageable with male projections on wall panels or corner panels. Thus, block insulation at formwork exterior portions can have female portions but lack male portions. Contrarily, block insulation at formwork exterior portions can be engageable with female projections on wall panels or corner panels. Thus, block insulation at formwork exterior portions can have male portions but lack female portions. The insulation can also be pre-installed on the panels before the panels are attached to the formwork. The male and female portions can permit insulation segments to be connected to each other. For example, a male projection can be operative to be received in a female opening with a snap fit or locking connection.

Figure 60:
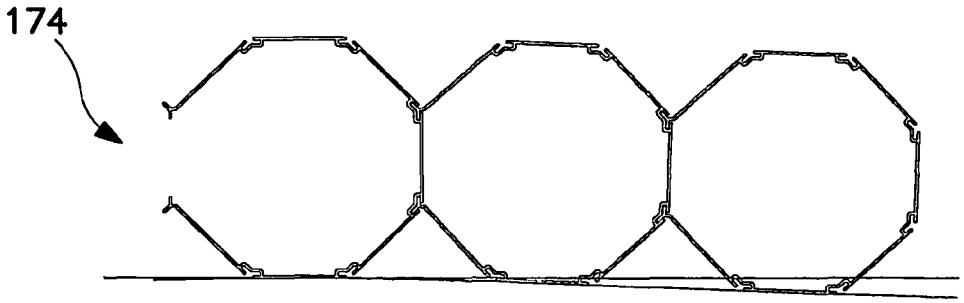
FIG. 60 shows a formwork curvature arrangement.

Instead of a flat wall formwork arrangement, a curved or circular formwork arrangement can also be created by use of the present invention. Form work components can be bent to create formwork curvature. For example, flexing can occur in the engagement fins of a male engaging portion (and in open vertices of a female engaging portion). Additionally, a formwork curvature can be created by providing a predetermined slop or play in the engagement of the male and female portions. In exemplary embodiments, curves can be formed using only tolerances and normal joint flex with formwork internal radii ranging from two inches to fifty feet. Of course additional angles of curvature can be enabled with use of other male and female play tolerances. FIG. 60 shows an example of formwork curvature 174 permitted by play in the engagement of male and female portions. A straight shadow line is shown for comparison.

Figure 61:
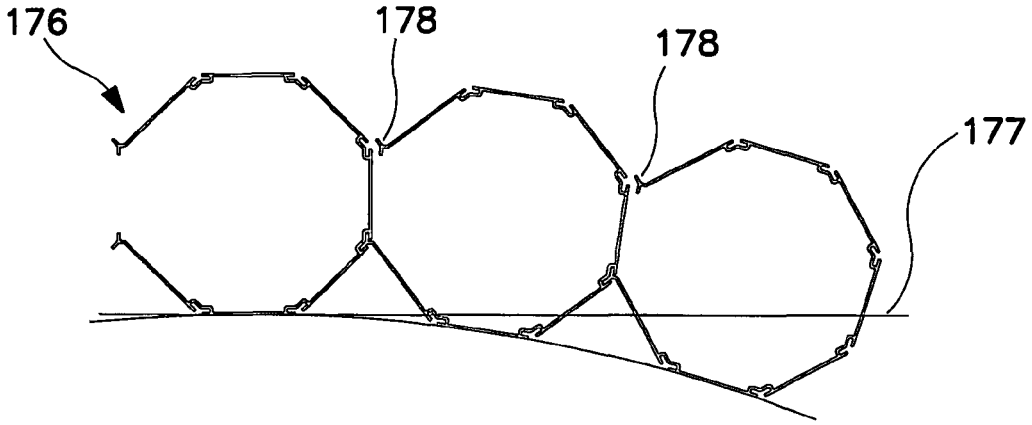
FIG. 61 shows another formwork curvature arrangement.

Other formwork curvature arrangements can be provided by using fewer connectors in the interior joints than in the outer joints. Further, the size or dimensions of formwork components can be adjusted to achieve even more curvature arrangements. FIG. 61 shows an example of formwork curvature 176 permitted by use of external joint connectors 178. A straight shadow line 177 is shown for comparison. Other curvature arrangements are also available. For example, a wall can be comprised solely of engaged external joint connectors, with curvature thereof created by play in the engagement of male and female portions.

The formwork components can be assembled using mating of corresponding male and female portions to form a predetermined formwork profile. Examples of different assembly stages are shown in the various drawings.

Furthermore, formwork components can include male and/or female portions that permit a formwork to attach to other non-formwork structure. For example, trim, molding, window, door bucks, service raceways, piping, supports, or ceiling related structure can be attached to a formwork via male and/or female engagements. A female (or male) component of a ceiling related structure could be connected to a concrete filled formwork by fasteningly engaging with a male (or female) component of the formwork.

Figure 62:
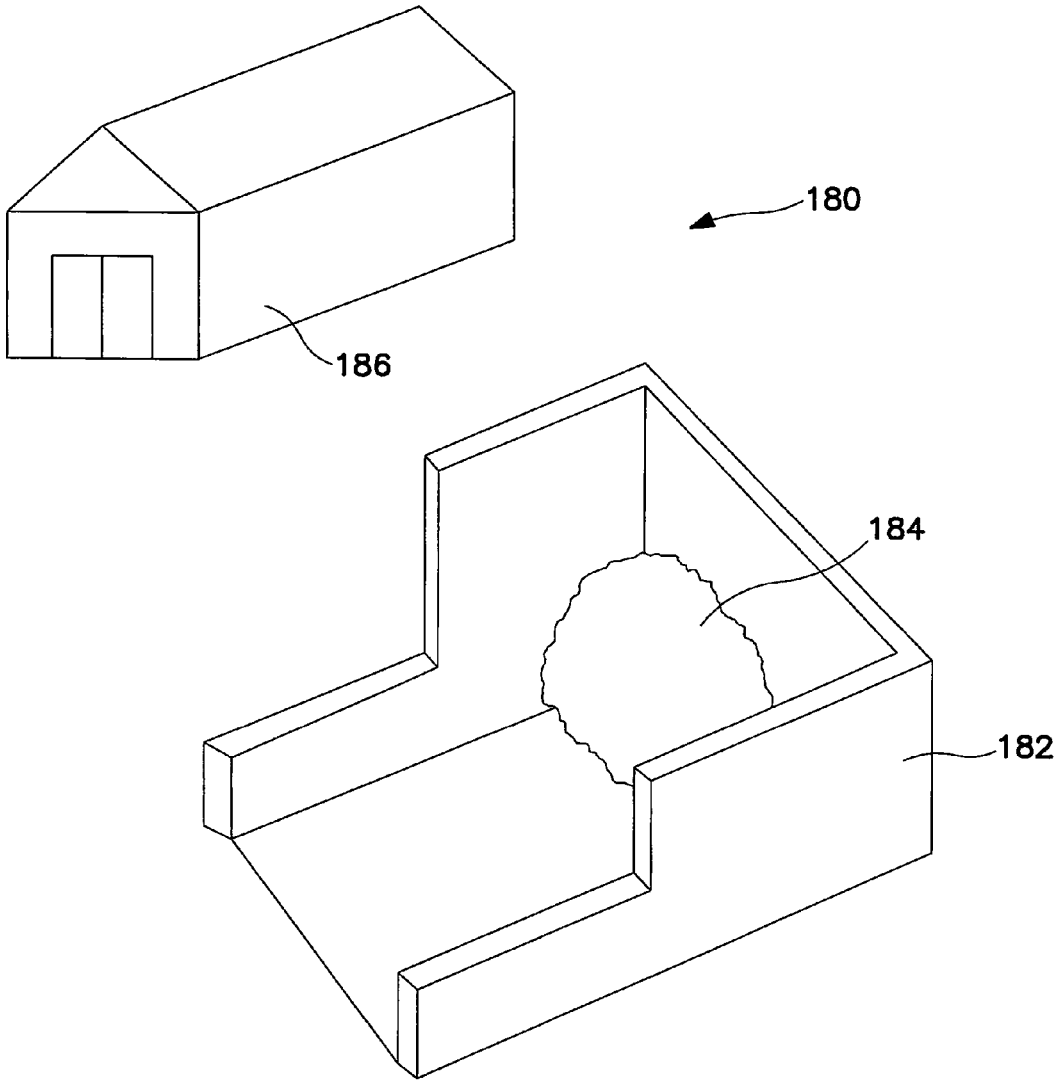
FIG. 62 shows an exemplary agriculture facility holding structure.

The formwork of exemplary embodiments can be used in an agriculture facility, such as a livestock barn. For example, an agriculture facility can have a need of a structure capable of storing agriculture feed or waste in the form of liquid, slurry, and/or solid. The waste can comprise livestock's manure products. The formwork of certain embodiments of the present invention is suited for use with agriculture material. The material and arrangement of a formwork are capable to structurally retain and provide chemical resistance to agriculture material such as waste products. A concrete hardened formwork arrangement also permits easy cleanup or removal of waste from the holding structure. FIG. 62 shows such an agriculture facility 180 including a barn 186. A cut away sectional view of a holding structure 182 containing agriculture material (e.g., feed or waste) 184 is also shown. Both the walls and floor of the holding structure can be made of concrete formwork arrangements of the present invention.

Another agriculture facility can require a storage area for vegetable or crop products. For example, in crop storage the avoidance of a damp humid environment can be desirable. The formwork of exemplary embodiments can include apertures or openings on an exterior portion thereof to provide entry and drainage of fluid for environmental control of a storage area.

The apertures can be provided to achieve ventilation for a storage area. For example, apertures can permit circulation of a fluid, such as air, in providing a relatively dry environment. The use of apertures for ventilation can also permit enhanced temperature control of a storage area. For example, apertures can provide acceptable cooling levels for stored goods. Additionally, other arrangements of a storage structure using a formwork of the present invention can include having apertures extended, such as by hollow tubes, into an interior storage area.

Figure 63:
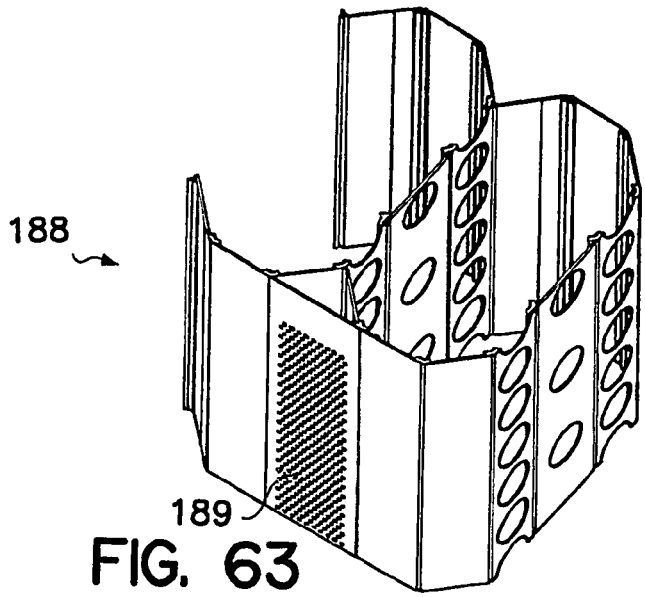
FIG. 63 shows an example of a formwork section having apertures.

FIG. 63 shows an example of a formwork section 188 having apertures, perforations, or openings 189 on a (interior or exterior) portion thereof. Apertures can be in a variety of formwork components, such as form elements or panels (e.g., wall panels). As previously discussed, apertures can be used for a variety of purposes, such an in providing venting or drainage. Apertures can also be used to prevent and/or remove hydrostatic pressure acting on a formwork. As previously discussed, apertures can be used as concrete flow perforations to permit a predetermined amount of concrete to flow therethrough to the exterior (or interior) portion of the formwork. Such exposed concrete can be used to attach other structures, such as a finish (e.g., brick), to the concrete wall.

Figure 64:
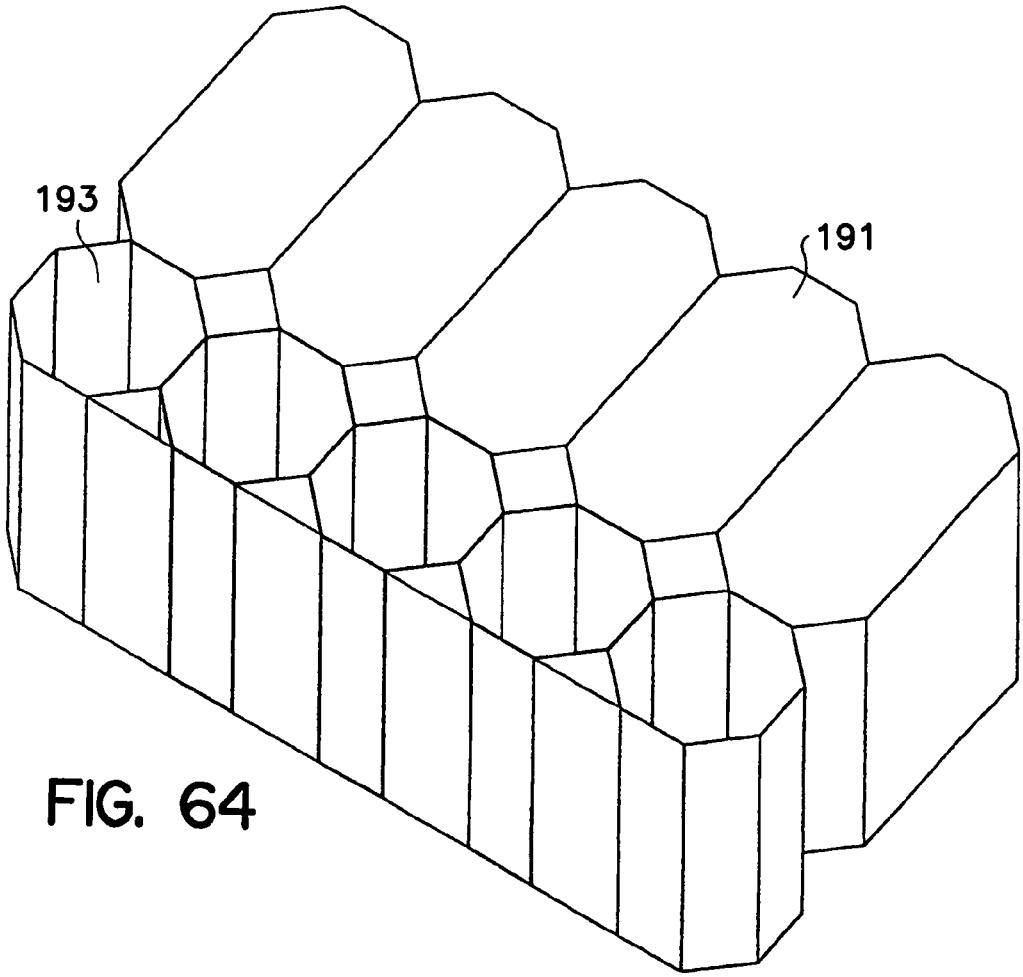
FIG. 64 shows a formwork section having a filled portion and a hollow portion.

FIG. 64 shows a formwork section having a material (e.g., concrete) filled portion 191 and a hollow chamber portion 193. As previously discussed, apertures can be associated with a hollow chamber for venting, drainage, and/or insulation.

Figure 65:
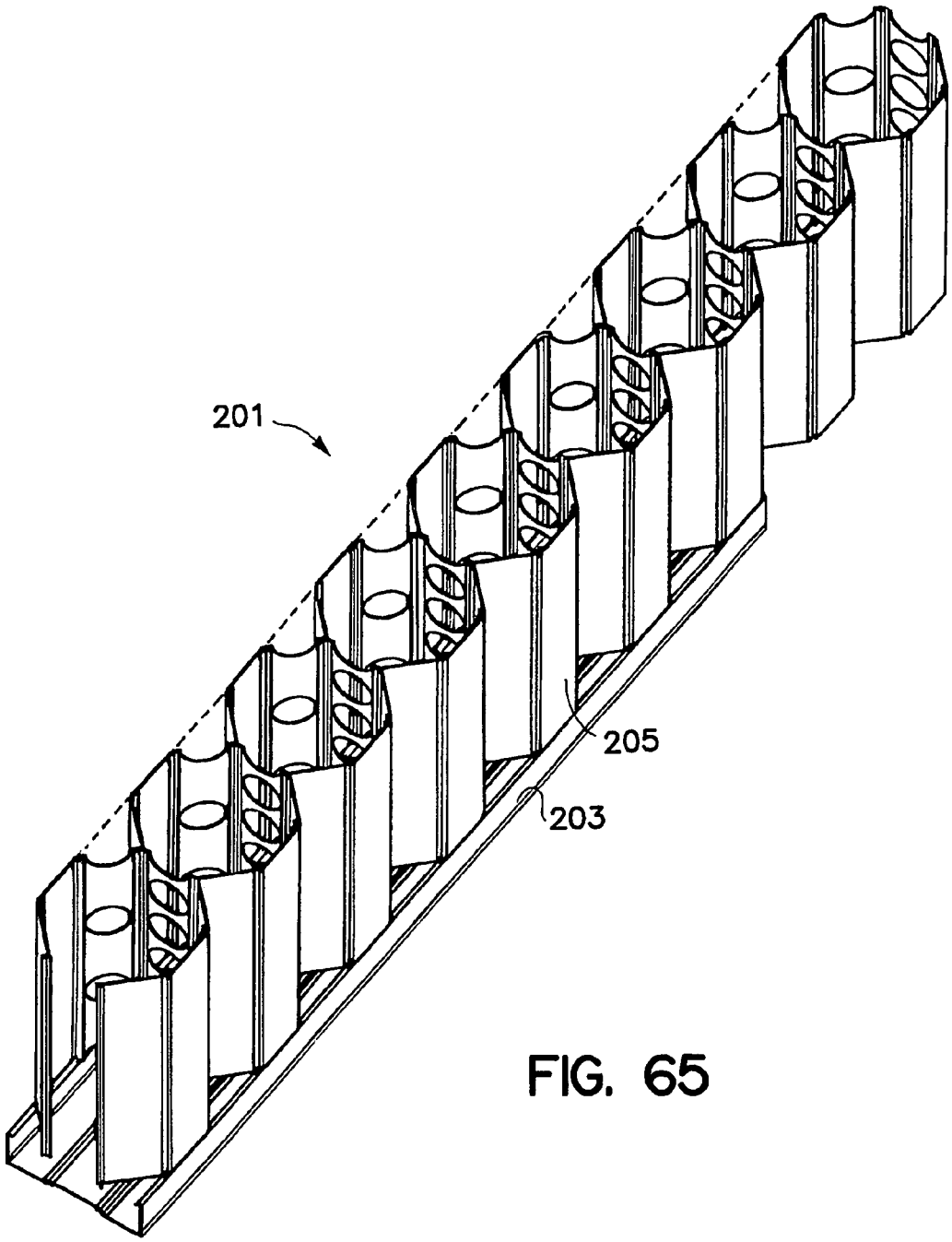
FIG. 65 shows an angled view of exemplary form elements and a drainage system.

Use of a formwork arrangement in combination with a drainage system has been previously discussed. For example, the cross-sectional triangular open area 24 shown in FIG. 7 can remain devoid of concrete so as to act like a drainage channel. FIG. 65 also shows an example of a drainage arrangement. Depending on the desired storage arrangement, drainage apertures or perforations can be located in the wall panels and/or corner panels and/or the form elements. The bottom of a drainage channel can be in fluid communication with a drainage system. Fluid and/or liquid could (interiorly or exteriorly) enter a drainage channel and then proceed by gravity toward the drainage system for removal. For example, during cool storage of a crop relatively humid air could enter through apertures in a wall panel then condense on a closed form element then fall to a drainage system. Thus, a formwork arrangement can be combined in a system to selectively remove moisture and control environmental conditions.

FIG. 65 shows an angled view of an exemplary partial arrangement of a drainage system 201 with hollow form elements. A catch drain 203 is shown beneath form elements 205. The catch drain can be sloped or pumped to assist in removal of liquid. The arrangement of FIG. 65 can be used to capture fluid from the form elements and/or from an area exterior of the form elements. That is, the form elements of FIG. 65 can contain concrete with the exterior space between the filled form elements acting as a longitudinal drain channel to a drain system. A drainage system can also be arranged to be in fluid communication with perforations in formwork panels (e.g., wall panels and/or corner panels). That is, instead of an open exterior space, perforated panels can be used. For example note FIG. 63. Furthermore, a drain system need not be directly under the form elements.

Figure 66:
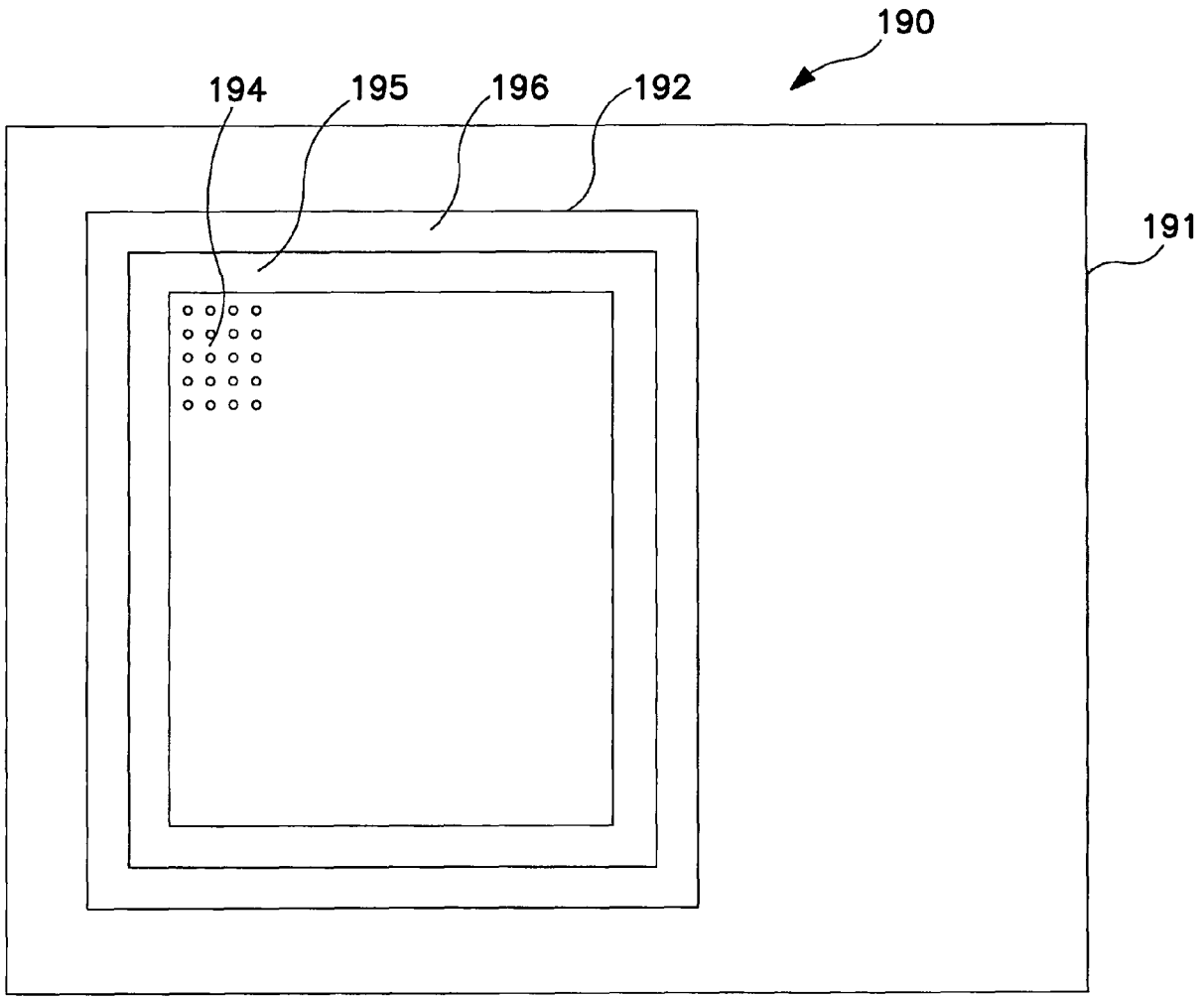
FIG. 66 shows an exemplary agriculture facility storage arrangement.

FIG. 66 shows such an agriculture facility storage arrangement. FIG. 66 shows an agriculture facility 190 including a building 191. A cross sectional top view of the building 191 shows a storage structure 192 containing a moisture sensitive crop product 194. The storage structure 192 can include a concrete formwork wall 195 and an exterior layer of hollow form elements 196 located above a drain system. That is, the facility of FIG. 66 can include a concrete filled portion and a hollow chamber portion, such as shown in FIG. 64. The facility of FIG. 66 can use a previously discussed drainage system, such as one similar to that shown in FIG. 65. That is, the form elements 196 of FIG. 66 can correspond to the form elements 205 of FIG. 65.

Figure 67:
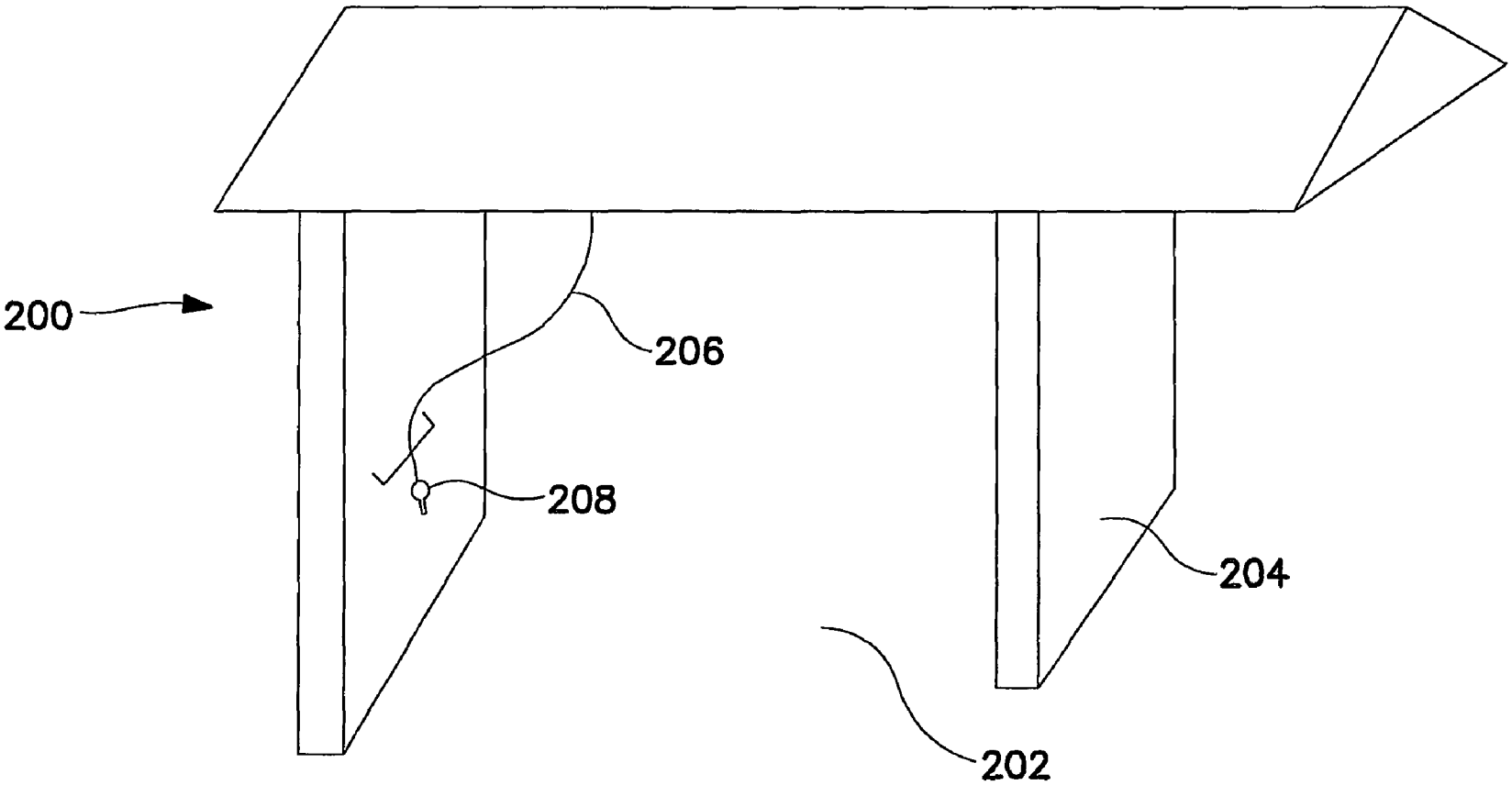
FIG. 67 shows an exemplary vehicle wash facility.

Additionally, an exemplary formwork can be adapted for use in a cleaning facility, such as in a vehicle wash facility. A self spray type of car wash can produce a buildup of dirt from washed vehicles. This dirt can accumulate on the walls of the car wash. The material and (smooth) flat wall construction of the formwork of exemplary forms of the present invention can permit ease of cleaning to maintain an attractive wall appearance. The attractiveness of the wall appearance can further be enhanced with surface treatment and/or the addition of colorant (such as a bright or shiny color or finish) to the wall material. Alternatively, an adhesive-backed graphics layer can be applied to the outer surface to provide a different aesthetic appearance. A clear, transparent, semi-transparent, or translucent wall material can also be used. FIG. 67 shows an example of a vehicle wash facility 200 including a vehicle wash bay 202. The wash bay has a concrete wall 204 formed using a previously discussed formwork. A hose 206 and spray nozzle 208 for a self-wash facility are also illustrated. Of course the vehicle wash facility can comprise a drive-thru facility.

An exemplary embodiment can also comprise a differential elevation extension formwork. For example, a first portion of the formwork can extend in a longitudinal direction further than at least one other portion of the formwork. Certain structure can require or benefit from a (flat) wall adjoining a (flat) ledge, step, or shelf. The wall can extend in a (vertical) direction further than the ledge. The wall and ledge can also be of different thickness. Furthermore, both the wall and ledge can be filled with concrete. The ledge can serve various purposes, such as a brick ledge, a supporting structure, storage area, garden area, a bench, etc.

Figure 68:
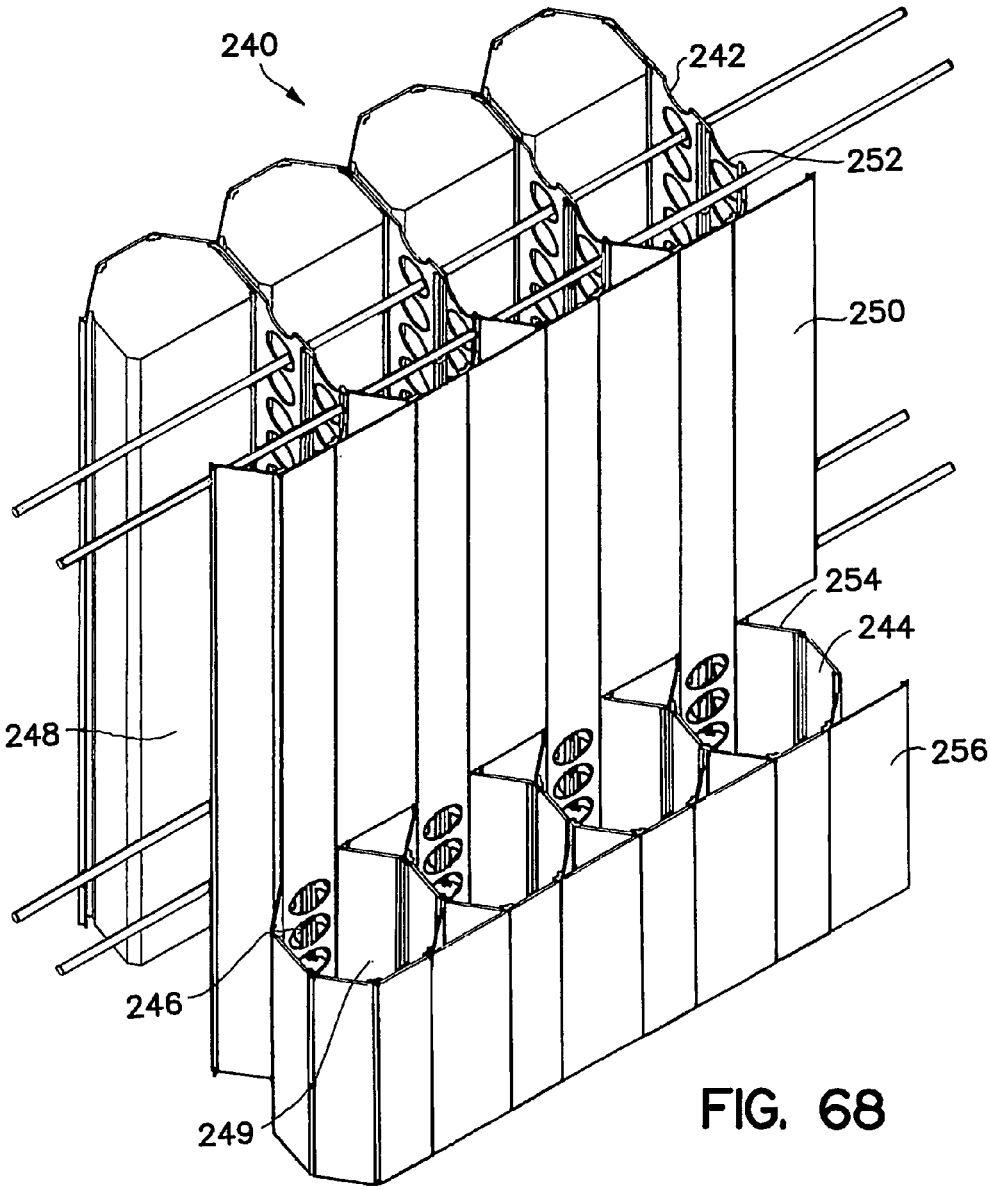
FIG. 68 shows an example of a formwork having a differential elevation arrangement.

FIG. 68 shows an example of a formwork having a differential elevation arrangement 240. A first formwork section 242 continues extending in an elevated direction from a second formwork section 244. The sections 242, 244 can share common apertures 246. Thus, concrete can flow through the apertures 246 to adjacent form element chambers 248, 249.

The sections 242, 244 can extend from a common base location, such as the ground, with the section 242 continuing to extend further (upward) than the section 244. The relative differences in lengths of the sections 242, 244 can vary.

An exemplary embodiment of the present invention permits a formwork with one or more ledges to still have a flat wall configuration. That is, both formwork sections 242, 244 can have flat wall panels (and corner panels). Wall panels 250 attached to the upper section form elements 252 can rest on form elements 254 of the lower or stepped section 244. As shown the ledge section 244 can also have flat wall panels 256.

The formwork sections can also contain different types of material. Additionally, one of the formwork sections can be hollow. For example, the ledge section 244 can be closed to fluid communication with the elevated section 242. That is, the sections can be without common apertures. Thus, concrete can be prevented from entry into the ledge section, which can remain hollow. Alternatively, certain chambers in a ledge section can be hollow while other chambers can contain concrete. For example, every other chamber in a ledge section can be hollow. The previously discussed embodiments regarding formwork component arrangements, venting, drainage, rebar, and insulation are also applicable to ledge sections.

Other embodiments can include more than one ledge section attached to an elevated section. For example, ledge sections can be located on each side of an (single) elevated section. Alternatively, elevated sections can be located on each side of a (single) ledge section. An arrangement can also comprise ledge sections located on each side of an elevated section, where the ledge sections share a common base but the lower end or level of the elevated section begins at a level above the common base level. For example, the bottom end of an elevated section may begin at or near the upper end of a ledge section. Likewise, a ledge section may be situated intermediate adjacent elevated sections. For example, the ledge and elevated sections can all share a common top base, but the lower end of the ledge section not beginning at the common lower base of the elevated sections. Hence, a hollow or tunnel-like arrangement can be formed. Other arrangements can include each of the elevated and ledge sections sharing a common lower base. A ledge section can also be located at an elevation above another ledge section. Furthermore, the ledge sections themselves can be viewed elevated sections with the addition of more ledges sections. For example, a formwork can take the configuration of a plurality of steps.

Figure 69:
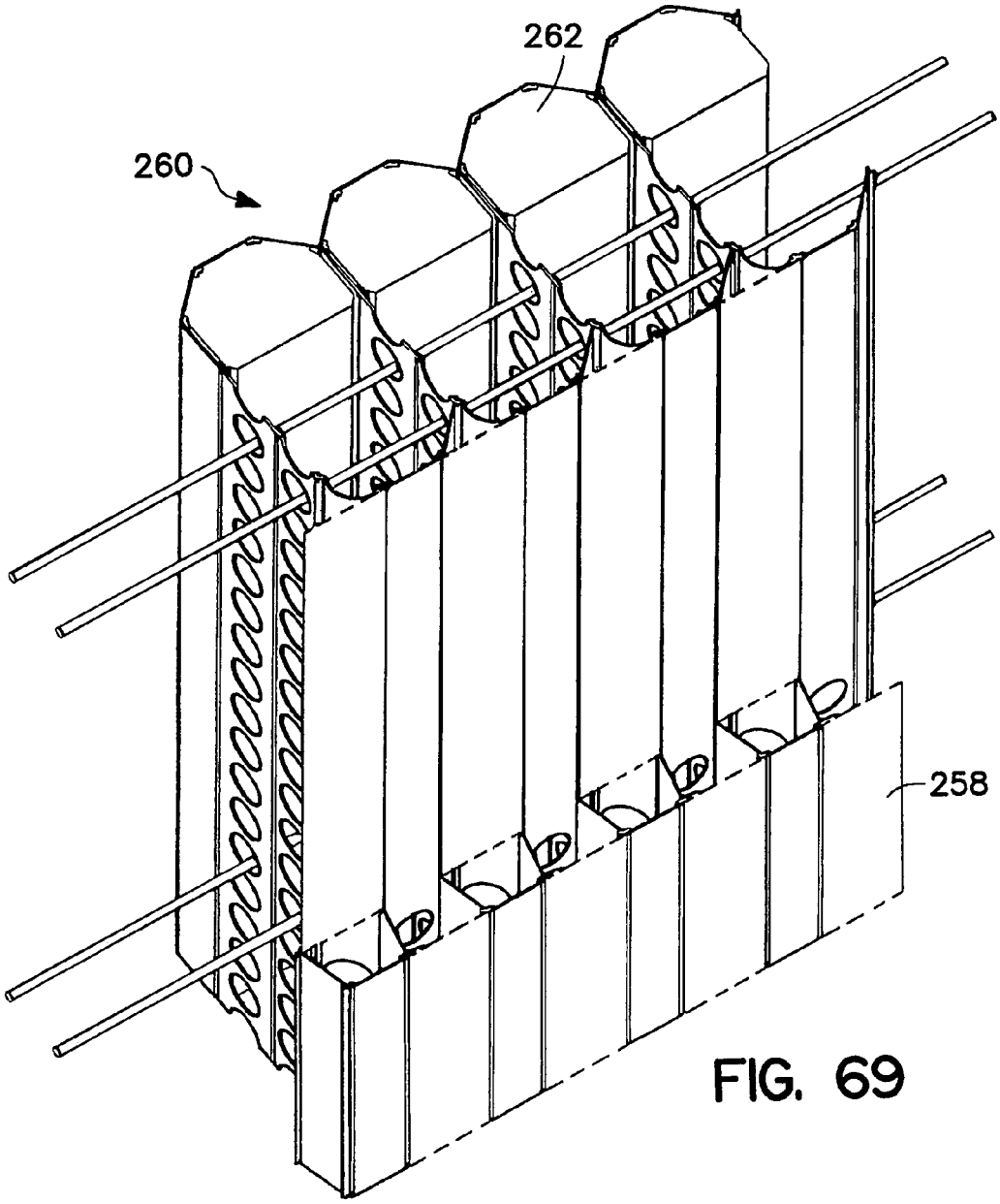
FIG. 69 shows another example of a formwork having a differential elevation arrangement.

FIG. 69 shows another example of a formwork having a differential elevation arrangement 260. The arrangement permits the use of extended wall panels 258. Insulation 262 can also be used.

Other embodiments of a formwork structure can also be used in applications other than those previously described. A formwork of the present invention is adapted for use in many diverse structures. Such applications and/or structures can include (but are not limited to) clean area environments, shelters (e.g., bunkers), vaults, highway dividers, barns, storage facilities, light factories, food handling facilities, warehouses, pools, residential structures, retaining walls, sound barriers, parking garages, storage of radioactive materials, etc. A formwork can have wall surface characteristics that allow ease and thoroughness of cleaning. Exemplary forms of the formwork provide resistance to earthquake crumple. The concrete structure produced by a formwork can be used in above ground, below ground, or aqueous conditions.

Figure 70:
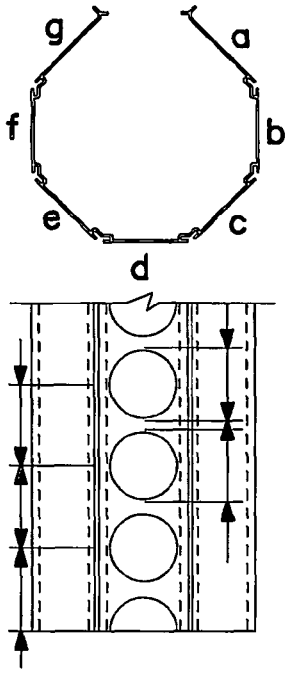
FIGS. 70 and 71 show exemplary form element aperture patterns.
Figure 71:
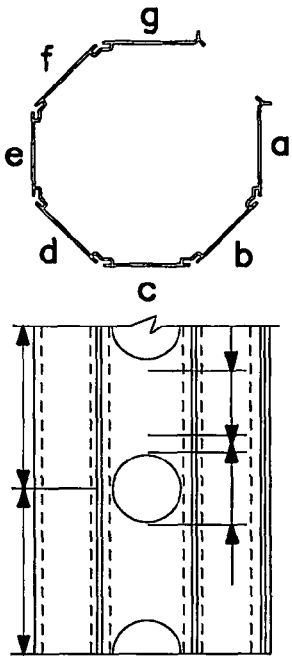

The usage of apertures in formwork arrangements has been previously discussed. FIGS. 70 and 71 show an exemplary embodiment of hole patterns (or aperture spacings) for a (regular) octagonal form element. The form element has faces a-g. FIG. 70 corresponds to faces b, d, and f. Face d is shown in FIG. 70. FIG. 71 corresponds to faces a, c, e, and g. Face c is shown in FIG. 71.

Figure 72:
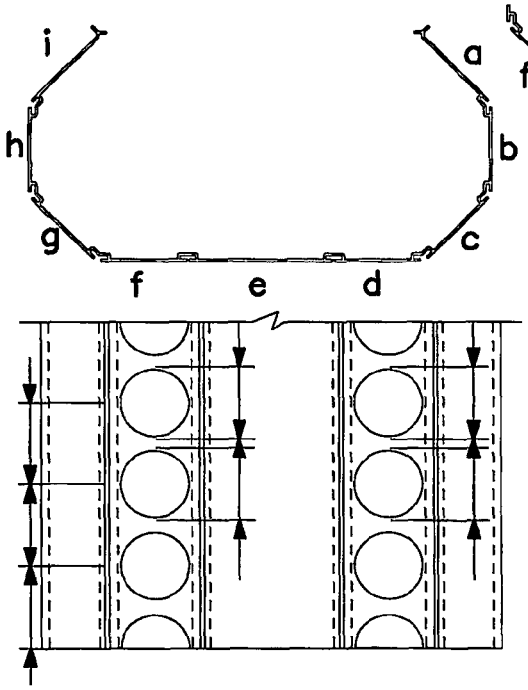
FIGS. 72 and 73 show exemplary elongated form element aperture patterns.
Figure 73:
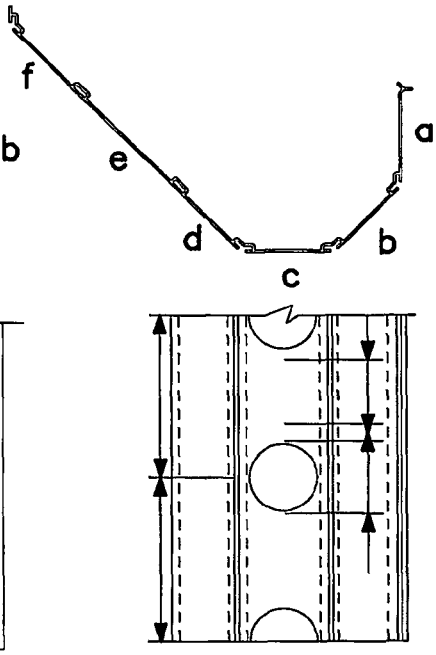

FIGS. 72 and 73 show an exemplary embodiment of hole patterns (or aperture spacings) for an elongated octagonal form element. The form element has faces a-i. FIG. 72 corresponds to faces b, d, f, and h. Faces d and f are shown in FIG.

72. FIG. 73 corresponds to faces a, c, g, and i. Face c is shown in FIG. 73. In FIGS. 70-73 the apertures can be formed in various procedures, including during or after form element fabrication, such as by punching. FIGS. 70-73 also show that different faces can have different hole patterns.

Figure 74:
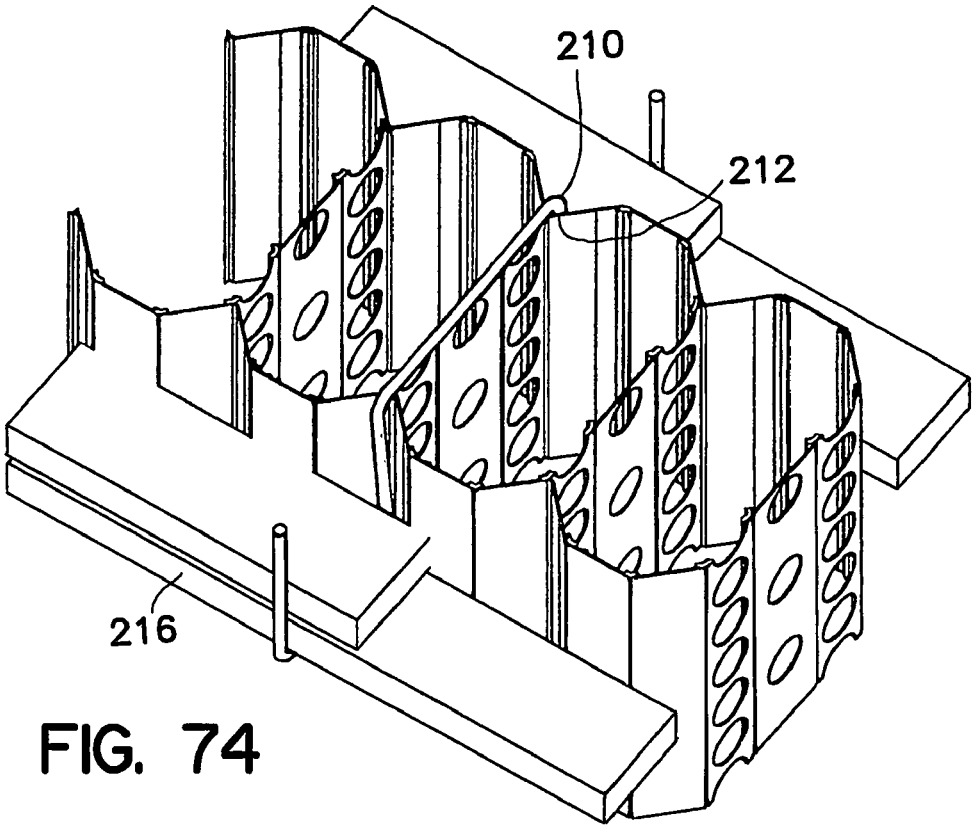
FIG. 74 shows an example of a formwork wall with alignment saddles.
Figure 75:
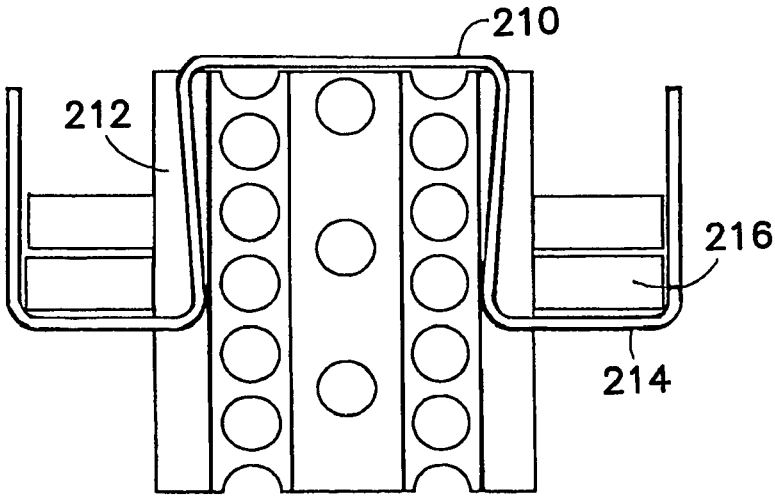
FIG. 75 is a side view of the arrangement of FIG. 74.

In exemplary formwork assembly methods an alignment system can be used to prevent or reduce bowing or bending of a wall portion of the formwork. For example, the bowing can be due to the force of concrete against the formwork wall. As shown in FIG. 74, removable saddles 210 can be set on a formwork upper wall portion 212. FIG. 75 is a side view of the arrangement of FIG. 74. The saddles 210 can extend on both sides of a wall portion. The saddles can rest on and be supported by a wall portion. Saddles can be of various sizes to extend various lengths down a wall. Each saddle can have one or more supporting members 214. For example, a saddle can have a supporting member positioned on each side of a wall portion. The saddles and supporting members can comprise a material such as metal, wood, or plastic. The supporting members are adapted to provide support to an alignment device or straightening device.

An alignment device 216, such as a waler, can comprise any elongated member capable of providing a restraining force against an expanding or bowing upper wall portion, such as during a concrete pour. An alignment device can be operative to provide or maintain substantial wall portion straightness or prevent wall collapse. An alignment device can comprise one or more pieces. A piece can comprise a material such as metal or wood. The saddles and the supporting members thereof can be arranged to press alignment devices closely against the wall portion. The saddle supporting members can match or exceed the exterior dimensions of an alignment device to prevent movement thereof away from a wall during usage. As shown in FIG. 74 a saddle 210 can extend inward from an outermost edge of the formwork upper wall portion. That is, saddle 210 does not have to contact or extend beyond the outermost edge of the upper wall portion. This can be due to the absence or non-use of wall panels adjacent the location of the saddle.

Figure 76:
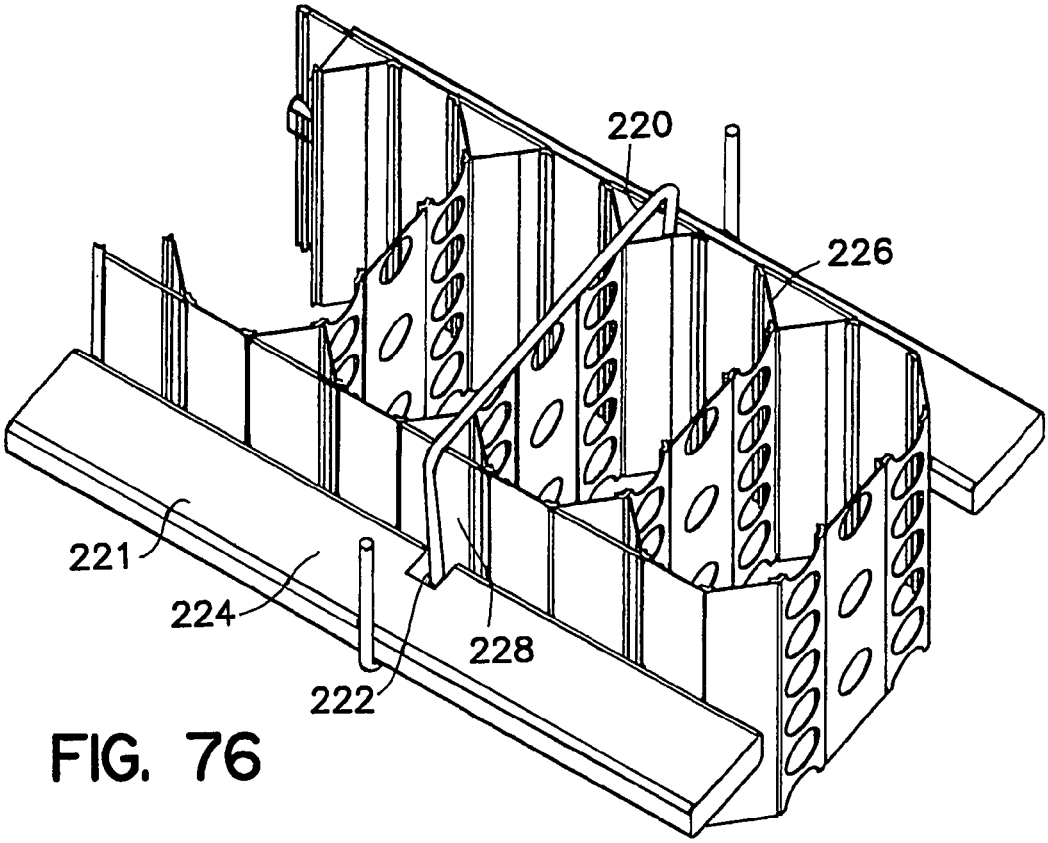
FIG. 76 shows another example of a formwork wall with alignment saddles.
Figure 77:
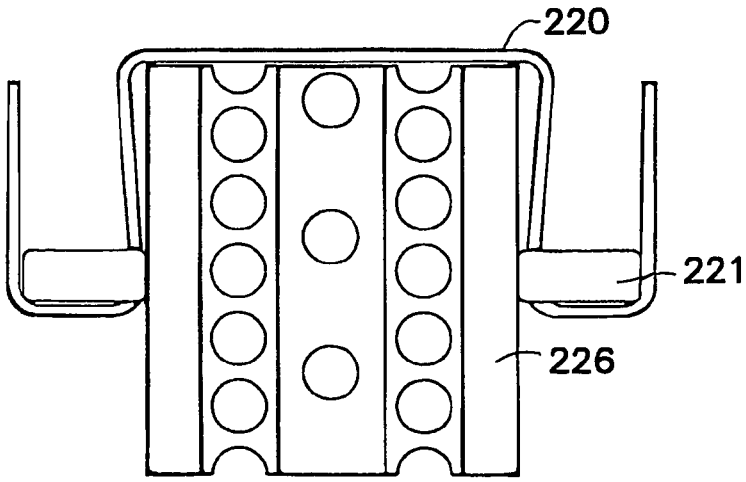
FIG. 77 is a side view of the arrangement of FIG. 76.

In other embodiments, an alignment device can have a thinner section adjacent its saddle to permit a thicker section to extend toward the wall for contact thereof. That is, an alignment device 221 can have a cutout 222 to permit a thicker section 224 thereof to cover the gap distance created by the thickness or overlap of a saddle 220, such as shown in FIGS. 76 and 77. FIG. 77 is a side view of the arrangement of FIG. 76. As shown in FIG. 76 a saddle 220 can be used which extends beyond an outermost edge of the formwork upper wall portion 226, which can comprise a flat wall panel 228. This can be due to the use of a cutout 222. Wedges can also be used. For example, a wedge can be used with a supporting member to press an alignment device toward the wall. Also, a wedge can be used between (intermediate) an alignment device and the wall.

In an example, two saddles can be spaced on a wall portion to support two 2×4 wood pieces, with each respective wood piece supported on a respective wall side. The wood pieces limit outward expansion of the wall. Of course use of more than two saddles can be employed to support a single alignment device. Furthermore, use of more than two saddles can be employed to support more than one alignment device on a wall side. After the concrete has hardened, the saddles and alignment devices can be removed.

In use a formwork can be assembled to receive concrete into the form elements or other chambers adjacent to the form elements. As previously discussed, flow apertures can also be used. Additionally, concrete can be poured before a formwork profile is completed. In this manner a formwork profile can be completed in stages. For example, a first section of the formwork profile can contain wet concrete while the next section is still being assembled. The use of staged construction can result in more efficient assembly.

Thus, exemplary embodiments of the invention achieve at least one of the above stated aspect, eliminate difficulties encountered in the use of prior systems and method, solve problems, and attain the desirable results described above.

In the foregoing description certain terms have been used for brevity, clarity, and understanding. However, no unnecessary limitations can be implied therefrom because such terms are used for descriptive purposes and are intended to be broadly construed. Moreover, the description or illustrations given are by way of examples and the invention is not limited to the exact details shown or described.

LISTING OF REFERENCE NUMERALS

| | |
|---|---|
| 10 | form element |
| 12 | vertex |
| 13 | interior chamber |
| 14 | wall |
| 16 | open face |
| 18 | female engagement portion |
| 20 | male engagement portion |
| 21 | formwork arrangement |
| 22 | wall panel |
| 24 | channel area |
| 25 | wall panel end |
| 26 | male engagement portion |
| 28 | fin |
| 30 | corner panel |
| 32 | corner panel end |
| 34 | male engagement portion |
| 38 | fin |
| 40 | flat wall |
| 42 | flat wall |
| 44 | corner panel |
| 46 | corner panel end |
| 48 | male engagement portion |
| 50 | fin |
| 52 | flat wall |
| 54 | flat wall |
| 56 | perforations |
| 57 | channel |
| 58 | channel |
| 60 | external joint connector |
| 62 | male engagement portion |
| 64 | female engagement portion |
| 70 | internal joint connector |
| 72 | male engagement portion |
| 74 | male engagement portion |
| 76 | double walled portion |
| 80 | elongated form element |
| 82 | female engagement portion |
| 83 | wall surface |
| 84 | leading wall |
| 85 | wall surface |
| 86 | open face |
| 87 | form element |
| 88 | formwork arrangement |
| 89 | elongated form element |
| 90 | formwork |
| 92 | buck panel |
| 94 | buck panel |
| 96 | male engagement portion |
| 97 | male engagement portion |
| 98 | female engagement portion |
| 99 | female engagement portion |
| 100 | form element |
| 101 | wall panel |
| 102 | wall panel |
| 103 | wall panel |
| 104 | wall panel |
| 106 | corner panel |

-continued

| LISTING OF REFERENCE NUMERALS | |
|---|---|
| 107 | male portion |
| 108 | corner panel |
| 109 | male portion |
| 110 | apertures |
| 111 | male engagement portion |
| 112 | buck panel |
| 113 | male engagement portion |
| 114 | buck panel |
| 115 | male engagement portion |
| 116 | buck panel |
| 117 | male engagement portion |
| 118 | buck panel |
| 122 | form element |
| 124 | form element |
| 126 | form element |
| 128 | form element |
| 130 | form element |
| 132 | apex |
| 134 | female portion |
| 136 | face |
| 137 | female portions |
| 138 | elongated form element |
| 139 | wall |
| 140 | form element |
| 141 | formwork |
| 142 | wall |
| 143 | insulation |
| 144 | closed female portion |
| 145 | insulation |
| 146 | closed female portion |
| 147 | chamber |
| 148 | form element |
| 149 | triangular portion |
| 150 | formwork |
| 151 | wall panel |
| 152 | insulation block |
| 153 | aperture |
| 154 | insulation block |
| 155 | formwork |
| 156 | male projection |
| 157 | insulation |
| 158 | female receiving opening |
| 159 | formwork aperture |
| 160 | formwork |
| 162 | insulation block |
| 163 | insulation block |
| 164 | insulation block |
| 165 | form element wall |
| 166 | male projection |
| 168 | female receiving opening |
| 169 | form element aperture |
| 170 | rebar (reinforcing bar) |
| 172 | rebar |
| 174 | formwork curvature |
| 176 | formwork curvature |
| 177 | shadow line |
| 178 | external joint connector |
| 180 | agriculture facility |
| 182 | holding structure |
| 184 | agriculture wastes |
| 186 | barn |
| 188 | formwork |
| 189 | aperture |
| 190 | agriculture facility |
| 191 | concrete filled |
| 192 | storage structure |
| 193 | hollow |
| 194 | crop product |
| 195 | concrete formwork wall |
| 196 | hollow form elements |
| 198 | drainage system |
| 200 | vehicle wash facility |
| 201 | drainage arrangement |
| 202 | wash bay |
| 203 | drain |
| 204 | concrete wall |
| 205 | form elements |

-continued

| LISTING OF REFERENCE NUMERALS | |
|---|---|
| 206 | hose |
| 208 | spray nozzle |
| 210 | saddle |
| 212 | upper wall portion |
| 214 | supporting member |
| 216 | alignment device |
| 220 | saddle |
| 221 | alignment device |
| 222 | cutout |
| 224 | thick portion |
| 226 | upper wall portion |
| 228 | wall panel |
| 240 | formwork arrangement |
| 242 | formwork section |
| 244 | formwork section |
| 246 | aperture |
| 248 | chamber |
| 249 | chamber |
| 250 | wall panel |
| 252 | form element |
| 254 | form element |
| 256 | wall panel |
| 258 | wall panel |
| 260 | formwork arrangement |
| 262 | insulation |

In the following claims any feature described as a means for performing a function shall be construed as encompassing any means capable of performing the recited function, and shall not be limited to the structures shown herein or mere equivalents.

The invention is not limited to the above embodiments. The claims follow.

What is claimed is:

1. An apparatus adapted for engagement with a concrete fillable formwork wall having elongated, octagonal tubular form elements consisting of:

a wall panel, wherein the wall panel consists of one substantially flat wall and two wall panel ends and a male engagement portion at each end, wherein each male engagement portion consists of a fin, wherein both fins extend from one side of the wall panel, and wherein each fin is adapted to engage a matching female engagement portion on one elongated, octagonal tubular form element;

whereby the engagement of the male engagement portions on the wall panel to matching female engagement portions of two elongated, octagonal tubular form elements forms a triangular closed area between the two elongated, octagonal tubular form elements and the wall panel, and whereby the engagement of the wall panel forms a substantially flat exterior wall surface along the elongated, octagonal tubular form elements to which the wall panel is engaged.

2. The apparatus of claim 1, wherein the wall panel has perforations.

3. The apparatus of claim 1, wherein the apparatus forms substantially flat walls of a building.

4. A method of finishing a plurality of elongated, octagonal tubular form elements to form a substantially flat wall, comprising the step of mating a male engagement portion of an end of an insert panel of claim 1 with a female engagement portion of at least one of an elongated, octagonal tubular form element.

* * * * *